US011659976B2

(12) United States Patent
Park et al.

(10) Patent No.: US 11,659,976 B2
(45) Date of Patent: May 30, 2023

(54) DISHWASHER HAVING CONDENSING DUCT AND RETURN DUCT

(71) Applicant: LG Electronics Inc., Seoul (KR)

(72) Inventors: Hyung Man Park, Seoul (KR); Seungyoun Kim, Seoul (KR); Min Jae Jeong, Seoul (KR); Kijoong Kang, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/508,525

(22) Filed: Oct. 22, 2021

(65) Prior Publication Data

US 2022/0125278 A1 Apr. 28, 2022

(30) Foreign Application Priority Data

Oct. 22, 2020 (KR) ..... 10-2020-0137875

(51) Int. Cl.
*A47L 15/48* (2006.01)

(52) U.S. Cl.
CPC ..... *A47L 15/486* (2013.01); *A47L 15/483* (2013.01); *A47L 15/488* (2013.01)

(58) Field of Classification Search
CPC ..... A47L 15/483; A47L 15/486; A47L 15/488
See application file for complete search history.

(56) References Cited

U.S. PATENT DOCUMENTS 5,337,500 A * 8/1994 Enokizono ..... A47L 15/488 34/233
5,524,358 A * 6/1996 Matz ..... A47L 15/488 34/235
9,677,770 B2 * 6/2017 Lee ..... F24C 15/006
2007/0251552 A1 * 11/2007 Lee ..... A47L 15/481 134/56 D (Continued)

FOREIGN PATENT DOCUMENTS

CN 109645929 A * 4/2019
EP 2241242 10/2010

(Continued)

OTHER PUBLICATIONS

Extended European Search Report in European Appln. No. 21204245.1, dated Feb. 23, 2022, 9 pages.

*Primary Examiner* — Joseph L. Perrin
*Assistant Examiner* — Irina Graf
(74) *Attorney, Agent, or Firm* — Fish & Richardson P.C.

(57) ABSTRACT

A dishwasher includes a tub, a door, and a drying device configured to supply air to a washing space in the tub. The drying device includes a drying duct that is disposed outside the tub and includes a condensing duct and a return duct, a fan configured to cause a flow of air in the drying duct, and a heater configured to heat the air in the drying duct. The condensing duct includes a first condensing duct connected to an inlet port configured to receive moist air from the washing space, and a second condensing duct disposed vertically below a bottom portion of the tub and connected (Continued)

to the first condensing duct. The return duct includes a return upstream end connected to the second condensing duct and a return downstream end connected to an outlet port configured to supply air to the tub.

20 Claims, 15 Drawing Sheets

(56) References Cited

U.S. PATENT DOCUMENTS

| | | | | |
|---|---|---|---|---|
| 2007/0261721 | A1* | 11/2007 | Eiermann | A47L 15/483 134/107 |
| 2013/0152981 | A1* | 6/2013 | Bertsch | A47L 15/0013 134/105 |
| 2014/0223761 | A1* | 8/2014 | Lee | A47L 15/488 34/218 |
| 2015/0257627 | A1* | 9/2015 | Park | A47L 15/483 34/72 |
| 2017/0196431 | A1* | 7/2017 | Hong | A47L 15/488 |
| 2018/0249884 | A1* | 9/2018 | Hofmann | A47L 15/488 |
| 2019/0216289 | A1* | 7/2019 | Vallejo | B01D 53/265 |
| 2019/0246871 | A1* | 8/2019 | Yoon | A47L 15/483 |
| 2019/0290097 | A1* | 9/2019 | Naik | A47L 15/50 |
| 2020/0100644 | A1 | 4/2020 | Kopera | |
| 2022/0104685 | A1* | 4/2022 | Wolowicz | A47L 15/488 |

FOREIGN PATENT DOCUMENTS

| | | | | |
|---|---|---|---|---|
| EP | 2757930 | | 7/2014 | |
| EP | 2949258 | | 12/2015 | |
| EP | 3718459 | | 10/2020 | |
| EP | 3741286 | A1 * | 11/2020 | |
| WO | WO-2007138064 | A1 * | 12/2007 | A47L 15/481 |
| WO | WO-2018040679 | A1 * | 3/2018 | A47L 15/42 |
| WO | WO-2019141187 | A1 * | 7/2019 | |

* cited by examiner

DISHWASHER HAVING CONDENSING DUCT AND RETURN DUCT

CROSS-REFERENCE TO RELATED APPLICATION

This application claims priority to and the benefit of Korean Patent Application No. 10-2020-0137875, filed on Oct. 22, 2020, the disclosure of which is incorporated herein by reference in its entirety.

TECHNICAL FIELD

The present disclosure relates to a dishwasher, and more particularly, to a dishwasher that improves drying performance and helps to prevent backflow of water by a simple configuration and at low cost, has a compact structure with a small size, and improves durability and stability.

BACKGROUND

A dishwasher is a household electrical appliance that may spray a washing liquid to washing targets such as dishes or cookware to remove foreign substances remaining on the washing targets.

In some cases, the dishwasher may include a tub configured to provide a washing space, a rack disposed in the tub and configured to accommodate dishes and the like, a spray arm configured to spray a washing liquid to the rack, a sump configured to store the washing liquid, and a washing pump configured to supply the spray arm with the washing liquid stored in the sump.

In some examples, the dishwasher may include a drying module. For example, the drying module may remove moisture remaining on the dish (a washing target or a drying target) by supplying heated air into the tub (a washing chamber).

The drying modules may be classified into an open-circulation drying module and a closed-circulation drying module. The open-circulation drying module may discharge moist air from the tub to the outside of the tub, heat outside air, and supply the heated air into the tub. The closed-circulation drying module may discharge moist air from the tub to the outside of the tub, remove moisture from the discharged air, and then supply the tub with the air from which the moisture is removed.

In some cases, the closed-circulation drying module may have better drying performance than the open-circulation drying module. But the manufacturing cost of the closed-circulation drying module may be higher than that of the open-circulation drying module. In some cases, the closed-circulation drying module may be installed in a wide installation space, which may limit reduction of a size of the dishwasher. Therefore, there is a need for a closed-circulation drying module capable of being simply manufactured at low cost, having a compact structure with a small size, and improving drying performance.

In some examples, the drying module may include a fan for allowing air to flow. In some cases, when water is introduced into a motor included in the fan, the fan may be broken down and may not perform the air-drying operation. Therefore, there is a need for a structure to help to prevent water from coming into contact with the fan.

In some examples, the drying module may include a heater for heating air. In some cases, when water is present at the periphery of the heater, the water may be vaporized into moisture vapor, and the moisture vapor may introduced into the tub, which may cause a deterioration in drying performance. Therefore, there is a need for a structure to help to prevent water from being present at the periphery of the heater.

In some cases, the fan or the heater may have a large size to effectively move or heat the air to improve the drying performance. Therefore, there is a need for a drying module that has a fan or a heater with a large size while the drying module having a compact structure with a small size.

In some examples, a dishwasher may include a drying system, in which air in a tub is discharged to the outside through a condensation assembly, and outside air is supplied into the tub through an assembly for blowing and heating drying air. The drying system may relate to the open-circulation drying module.

In some cases, a V-shaped flow tube may restrict water from coming into contact with a motor of the assembly for blowing and heating drying air. The V-shaped flow tube may have a long length and be installed in a large installation space, which limits reduction of a size of the drying module.

In some cases, where the length of the V-shaped flow tube is reduced to miniaturize the dishwasher, a size of a heater disposed in the V-shaped flow tube may decrease, which may lead to a decrease of an air heating area and a deterioration of a drying performance.

In some cases, water may be collected in an elbow portion of the V-shaped flow tube. In some cases, where the heater is disposed at the periphery of the elbow portion, the water may be vaporized into moisture vapor by the heater, and the moisture vapor may be introduced into the tub, which may lead to a deterioration of the drying performance.

SUMMARY

The present disclosure describes a dishwasher that can improve a drying performance by a simple configuration and at low cost.

The present disclosure also describes a dishwasher that can help to prevent water from flowing reversely.

The present disclosure further describes a dishwasher having a compact structure with a small size.

The present disclosure further describes a dishwasher that can reduce or prevent proliferation of bacteria or mold in a duct.

The present disclosure further describes a dishwasher having improved durability and stability.

The present disclosure further describes a dishwasher having an improved drying performance in spite of being provided with various components such as a washing pump and a sump lower than the bottom of a tub to reduce the installation space of the drying device.

According to one aspect of the subject matter described in this application, a dishwasher includes a tub having a washing space that is defined by a bottom portion of the tub, where the bottom portion defines an outlet port at a rear side thereof, an upper wall facing the bottom portion in a vertical direction, a rear wall facing a front side of the tub in a first direction, a first sidewall having an inlet port defined at a rear upper portion thereof, and a second sidewall facing the first sidewall in a second direction. The dishwasher further includes a door disposed at the front side of the tub and configured to open and close at least a portion of the washing space and a drying device configured to supply air to the washing space. The drying device includes a drying duct that is disposed outside the tub and in fluid communication with the inlet port and the outlet port, where the drying duct includes a condensing duct and a return duct. The drying device further includes a fan configured to cause a flow of air in the drying duct and a heater configured to heat the air in the drying duct. The condensing duct includes a first condensing duct that faces an outer surface of the first sidewall of the tub and has a first upstream end in fluid communication with the inlet port, and a second condensing duct that is disposed vertically below the bottom portion of the tub and has a second upstream end in fluid communication with a first downstream end of the first condensing duct. The return duct includes a return upstream end that is in fluid communication with a second downstream end of the second condensing duct, and a return downstream end that is in fluid communication with the outlet port.

Implementations according to this aspect can include one or more of the following features. For instance, the outlet port and the inlet port can be defined at positions on an imaginary vertical plane that extends in the second direction and the vertical direction. In some examples, the second condensing duct can be curved at the second downstream end and extend in the vertical direction. In some examples, a horizontal distance between the second upstream end and the second downstream end can be greater than a horizontal distance between the second upstream end and the outlet port.

In some implementations, the second condensing duct and the return duct can be positioned vertically below a rear portion of the bottom portion of the tub. In some examples, the return duct can be positioned between the bottom portion of the tub and the second condensing duct. In some examples, at least a portion of the return duct can face and extend along the second condensing duct in a longitudinal direction of the second condensing duct, and the drying device can further include a separation wall that is disposed at least the portion of the return duct. For example, the separation wall can be disposed between the return duct and the second condensing duct and extending in the longitudinal direction. In some examples, the separation wall can define a water drain hole in fluid communication with the return duct and the second condensing duct.

In some implementations, the fan and the heater can be disposed between the second downstream end of the second condensing duct and the return downstream end of the return duct. For example, the heater can be disposed in the return duct. In some examples, the fan can be disposed vertically above the second downstream end of the second condensing duct and in fluid communication with the return duct.

In some implementations, the fan can include a fan blade, a motor disposed vertically above the fan blade and configured to rotate the fan blade, and a fan housing that accommodates the fan blade, where the fan housing includes a housing upper wall that is disposed between the fan blade and the motor and that faces the second downstream end of the second condensing duct and the return upstream end of the return duct. In some implementations, the fan can include a rotary shaft that extends in the vertical direction.

In some implementations, the first downstream end of the first condensing duct can be positioned at a lower end of a rear portion of the first sidewall, and the second upstream end of the second condensing duct can be positioned at a side end of a rear portion of the bottom portion of the tub.

In some implementations, the dishwasher can include a cold air supply module that is disposed outside the tub and at least partially overlap with the first condensing duct. For example, the cold air supply module can include a first outside air inflow duct disposed vertically below the bottom portion of the tub and configured to receive air from an outside of the drying device, a second outside air inflow duct that faces the outer surface of the first sidewall and is in fluid communication with a downstream end of the first outside air inflow duct, and a heat exchange flow path part that is connected to the first condensing duct and in fluid communication with a downstream end of the second outside air inflow duct.

In some examples, the dishwasher can further include a cooling fan that is disposed in the first outside air inflow duct or an upstream end of the first outside air inflow duct, where the cooling fan is configured to draw air from the outside toward the first outside air inflow duct. In some examples, the heat exchange flow path part can extend along an outer circumferential surface of the first condensing duct and have a downstream end configured to discharge air to an outside of the drying device, where the downstream end of the heat exchange flow path part faces and is spaced apart from an end of the first condensing duct in the second direction.

In some implementations, the inlet port can be configured to receive air and moisture from the washing space and to supply the air and the moisture to the first condensing duct, where the first condensing duct is configured to guide the air and the moisture from the first upstream end to the first downstream end. The second condensing duct can be configured to receive the air and the moisture from the first condensing duct through the second upstream end and to guide the air and the moisture to the second downstream end. In some examples, the heater can be disposed in the return duct, and the return duct can be configured to guide air heated by the heater toward the return downstream end, where the outlet port is configured to receive the heated air from the return duct and to supply the heated air to the washing space.

In some implementations, where the outlet port meets an imaginary vertical surface that passes through the inlet port and extends in the second direction and the vertical direction, the horizontal distance between the outlet port formed in the bottom of the tub and the inlet port formed in one sidewall of the tub can be minimized. Therefore, the dry air introduced into the washing space through the outlet port can effectively circulate everywhere in the washing space until the dry air is introduced into the drying device through the inlet port. Therefore, the drying efficiency can be further improved.

In some implementations, where the second condensing duct is bent in the vicinity of a downstream end and extend in the vertical direction (e.g., upward), it can be possible to help to prevent the water, which is introduced into the second condensing duct or produced in the second condensing duct, from being introduced into the return duct.

In some implementations, where the outlet port is formed in the vicinity of the inlet port in the horizontal direction to improve the drying performance, a horizontal length of the return duct communicating with the outlet port and the downstream end of the second condensing duct can increase. In some examples, a distance between the downstream end of the second condensing duct and the upstream end of the return duct can increase.

In some implementations, a heater can have a large size and be disposed inside or outside the return duct, and the fan can be disposed between the upstream end of the return duct and the downstream end of the second condensing duct. Therefore, the drying performance of the dishwasher can be improved by the simple configuration, and the dishwasher can have a compact structure having a small size.

In some implementations, the second condensing duct and the return duct can be positioned only under rear portions of the bottom of the tub. Therefore, since the second condensing duct and the return duct are positioned at the rear side together with the outlet port and the inlet port, the second condensing duct and the return duct can be formed in a shape similar to a straight line, and the lengths of the ducts, and can decrease. Therefore, the flow resistance can be reduced, and the drying performance can be improved. In addition, the dishwasher can have a compact structure having a small size.

In some implementations, the return duct can be positioned between the bottom of the tub and the second condensing duct. Therefore, it can be possible to help to prevent the water introduced into the second condensing duct through the inlet port and the water condensed in the condensing duct from being introduced into the return duct. Therefore, it can be possible to help to prevent the water in the condensing duct from being introduced into the washing space S through the outlet port communicating with the return duct, thereby improving the drying performance.

In some implementations, the return duct and the second condensing duct can at least partially adjoin each other in the longitudinal direction of the return duct and the second condensing duct. At the portion where the return duct and the second condensing duct adjoin each other, the return duct and the second condensing duct can be separated by a separation wall W disposed in the longitudinal direction of the return duct and the second condensing duct. Therefore, the return duct and the second condensing duct can be easily manufactured by the simple configuration and at low cost. In addition, since the return duct and the second condensing duct are separated by the single separation wall, a part of heat generated from the heater disposed in the return duct can be easily transferred to the second condensing duct. Therefore, a small amount of water in the second condensing duct is vaporized by the heat transferred to the second condensing duct, and thus the humidity in the second condensing duct decreases, which makes it possible to help to prevent the proliferation of bacteria or mold in the second condensing duct.

In some implementations, the fan and the heater is disposed between the downstream end of the condensing duct and the downstream end of the return duct. Therefore, the fan can allow the air to smoothly flow in the downstream portion (e.g., between the condensing duct and the return duct) of the drying duct where the flow direction of the air is considerably changed, thereby reducing the flow resistance. Further, the heater can heat the air in the downstream portion (e.g., the return duct) of the drying duct close to the outlet port and discharge the high-temperature dry air into the washing space. As a result, it can be possible to improve the drying performance by the simple configuration and at low cost.

In some implementations, the heater can be disposed in the return duct. Therefore, since the high-temperature air, which is heated in the return duct close to the outlet port, flows into the washing space, the heated air flowing into the washing space can effectively remove moisture remaining on dishes in the washing space. Therefore, the drying performance can be improved by the simple structure and at low cost. In addition, since the heater does not come into contact with the water introduced into the condensing duct or the water condensed in the condensing duct, it can be possible to help to prevent the heat generated by the heater from vaporizing a large amount of water collected in the condensing duct. Therefore, the high-temperature dry air in the return duct can flow into the washing space, thereby improving the drying performance.

In some implementations, the fan can be disposed higher than the downstream end of the second condensing duct. Therefore, it can be possible to help to prevent a motor of the fan from coming into contact with the water introduced into the condensing duct or the water condensed in the condensing duct. Therefore, it can be possible to help to prevent the water from being introduced into the motor of the fan and thus help to prevent the fan from being broken down, thereby improving the durability and stability of the drying device.

In some implementations, the motor can be disposed above the fan blade, and the fan housing can include the upper wall disposed between the fan blade and the motor. Therefore, even though the fan blade comes into contact with the water introduced into the return duct through the outlet port, the water being in contact with the fan blade is blocked by the upper wall, such that the water cannot come into contact with the motor. Therefore, it can be possible to help to prevent the water from being introduced into the motor and thus help to prevent the fan from being broken down, thereby improving the durability and stability of the drying device.

In some implementations, the rotary shaft of the fan can extend in the vertical direction. Therefore, the fan can be installed to be laid between the second condensing duct and the return duct. Therefore, the fan having a sufficiently large size can be installed even though the installation space or the installation position is restricted. Therefore, the drying performance of the dishwasher can be improved by the simple configuration and at low cost, and the dishwasher can have a compact structure having a small size. In addition, since the motor can be disposed above the fan blade, it can be possible to help to prevent the water from being introduced into the motor.

In some implementations, the downstream end of the first condensing duct can be positioned in the vicinity of the lower end of the rear portion of one sidewall, and the upstream end of the second condensing duct can be positioned in the vicinity of one side end of the rear portion of the bottom. Therefore, since both the downstream end of the first condensing duct and the upstream end of the second condensing duct are positioned at the rear side together with the inlet port and the outlet port, the condensing duct can be formed in a shape similar to a straight line, and the length of the condensing duct can decrease. Therefore, the flow resistance can be reduced, and the drying performance can be improved.

In some implementations, the dishwasher can further include the cold air supply module disposed outside the tub and configured to at least partially adjoin the first condensing duct. Therefore, the cold air supply module can effectively remove moisture vapor, which is contained in the air flowing along the first condensing duct, by condensing the moisture vapor into the water. Therefore, the drying performance can be improved by the simple structure and at low cost.

In some implementations, the cold air supply module can include the first outside air inflow duct disposed lower than the bottom and configured to allow the outside air to be introduced thereinto, the second outside air inflow duct configured to face or adjoin the outer surface of one sidewall, and the heat exchange flow path part configured to adjoin the first condensing duct and communicate with the second outside air inflow duct. Therefore, it can be possible to effectively remove moisture vapor, which is contained in the air flowing along the first condensing duct, by condensing the moisture vapor into the water with the cold air lower than the tub. Therefore, the drying performance can be improved by the simple structure and at low cost.

In some implementations, the cooling fan can be disposed in the first outside air inflow duct or at the periphery of the upstream end of the first outside air inflow duct. Therefore, since the cooling fan can be disposed lower than the tub, the cooling fan can suction the cold air lower than the tub and supply the cold air to the heat exchange flow path part, thereby improving the cooling efficiency. In addition, because the space lower than the tub is comparatively large, it can be possible to improve the cooling efficiency by increasing the size of the cooling fan.

In some implementations, the heat exchange flow path part can extend along the outer circumferential surface of the first condensing duct, and the downstream end of the heat exchange flow path part can be positioned in parallel in the second direction with the end in the width direction of the first condensing duct. The air can be discharged to the outside through the downstream end of the heat exchange flow path part. Therefore, the heat exchange flow path part can be configured and the installation space of the heat exchange flow path part can be minimized by the simple configuration and at low cost. In addition, a length of the heat exchange flow path part is decreased, and the flow resistance is reduced, such that the cooling performance can be improved.

The specific effects of the present disclosure, together with the above-mentioned effects, will be described along with the description of specific items for carrying out the present disclosure.

DETAILED DESCRIPTION

Figure 1:
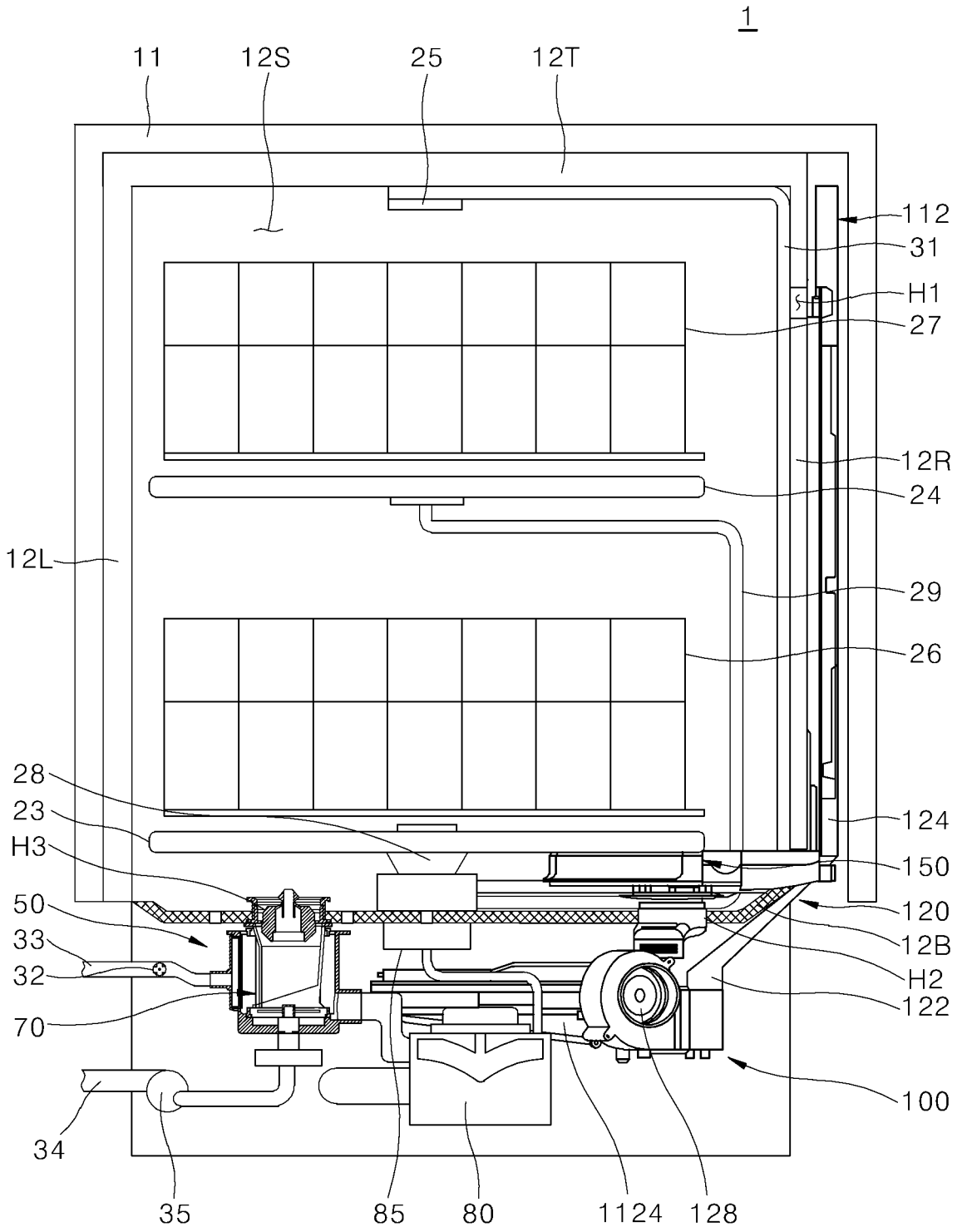
FIG. 1 is a cross-sectional view illustrating an example of a dishwasher.

Hereinafter, one or more implementations of the present disclosure will be described in detail with reference to the accompanying drawings. In the drawings, the same reference numerals are used to indicate the same or similar constituent elements.

For the convenience of description, a direction toward a front surface or a rear surface of a door of a dishwasher in a state in which the door is closed is defined as a first direction or a forward/rearward direction.

A second direction or a leftward/rightward direction can mean a direction toward left and right sides in the drawings illustrating a front surface of the door in the closed state.

Hereinafter, a dishwasher according to one or more implementations of the present disclosure will be described.

FIG. 1 is a cross-sectional view illustrating an example of a dishwasher.

In some implementations, referring to FIG. 1, the dishwasher 1 can include a cabinet 11, the tub 12, a plurality of spray arms 23, 24, and 25, a sump 50, a filter 70, a washing pump 80, a switching valve 85, a water supply valve 32, a water drain pump 35, and a drying device 100. The respective components will be described.

The cabinet 11 can define an external appearance of the dishwasher 1.

The tub 12 can be disposed in the cabinet 11. In some examples, the tub 12 can have a hexahedral shape opened at a front side thereof. However, the shape of the tub 12 is not limited thereto, and the tub 12 can have various shapes.

A washing space 12S can be defined in the tub 12 and accommodate a washing target. A door 14 (FIG. 2) for opening or closing the washing space 12S can be provided at a front side of the tub 12.

In some implementations, an inlet port H1 and an outlet port H2, which communicate with the drying device 100, can be defined in the sidewall 12R and a bottom 12B of the tub 12. In addition, the bottom 12B of the tub 12 has a communication hole H3 through which a washing liquid is introduced into the sump 50.

The door 14 (FIG. 2) can be disposed at the front side of the tub 12 and open or close the washing space 12S.

A plurality of racks 26 and 27 for accommodating the washing targets such as dishes can be disposed in the washing space 12S. The plurality of racks 26 and 27 can include a lower rack 26 disposed at a lower side of the washing space 12S, and an upper rack 27 disposed at an upper side of the washing space 12S. The lower rack 26 and the upper rack 27 can be disposed to be spaced apart from each other vertically and withdrawn toward a location in front of the tub 12 by sliding.

The plurality of spray arms 23, 24, and 25 can be disposed to be spaced apart from one another vertically. The plurality of spray arms 23, 24, and 25 can include a low spray arm 23, an upper spray arm 24, and a top spray arm 25. The low spray arm 23 can spray the washing liquid upward toward the lower rack 26. The upper spray arm 24 can be disposed above the low spray arm 23 and spray the washing liquid upward toward the upper rack 27. The top spray arm 25 can be disposed at an uppermost end of the washing space 12S and spray the washing liquid downward.

The plurality of spray arms 23, 24, and 25 can be supplied with the washing liquid from the washing pump 80 through the plurality of spray arm connecting flow tubes 28, 29, and 31.

The sump 50 can be provided lower than the bottom 12B of the tub 12 and collect and store the washing liquid. Specifically, the sump 50 can be connected to a water supply flow path 33 and supplied with the clean washing liquid including no foreign substances through the water supply flow path 33, and the sump 50 can store the clean washing liquid. In addition, the sump 50 can be supplied with and store the washing liquid from which foreign substances are removed by the filter 70.

The filter 70 can be disposed in the sump 50 and installed in the communication hole H3. The filter 70 can filter out foreign substances from the washing liquid containing foreign substances and moving from the tub 12 to the sump 50.

The water supply valve 32 can control the washing liquid supplied from a water source through the water supply flow path 33. When the water supply valve 32 is opened, the washing liquid supplied from the external water source can be introduced into the sump 50 through the water supply flow path 33.

A water drain flow path 34 can be connected to the water drain pump 35 and the sump 50.

The water drain pump 35 can be connected to the water drain flow path 34 and include a water drain motor.

When the water drain pump 35 operates, the foreign substances filtered out by the filter 70 or the washing liquid can be discharged to the outside through the water drain flow path 34.

The washing pump 80 can be disposed below the bottom 12B of the tub 12 and supply the plurality of spray arms 23, 24, and 25 with the washing liquid stored in the sump 50.

The switching valve 85 can selectively connect at least one of the plurality of spray arms 23, 24, and 25 to the washing pump 80.

The drying device 100 can be disposed beside one sidewall 12R and lower than the bottom 12B of the tub 12. The drying device 100 can communicate with the inside of the washing space 12S through the inlet port H1 and the outlet port H2. The drying device 100 can dry the washing space 12S in the tub 12.

In a drying step of the dishwasher 1, the moist air in the washing space 12S can be introduced into the drying device 100 through the inlet port H1, and the air dried by the drying device 100 can be introduced into the washing space 12S through the outlet port H2. The circulation of the air can be repeatedly performed. The drying device 100 can improve drying performance through the closed circulation of the air.

In some examples, a space capable of installing the drying device 100 can be narrow because various components, such as the washing pump 80, which constitute the dishwasher 1, are installed below the bottom 12B of the tub 12 and the sump 50 is provided lower than the bottom 12B of the tub 12. Therefore, the drying device 100 needs to have a compact structure having a small size so that the drying device 100 can be installed in the dishwasher 1.

A distributor 150 of the drying device 100 can be inserted into the washing space 12S through the outlet port H2. The distributor 150 can be disposed at an edge corner of the tub 12 so as not to collide with the rotating spray arm 23.

Figure 2:
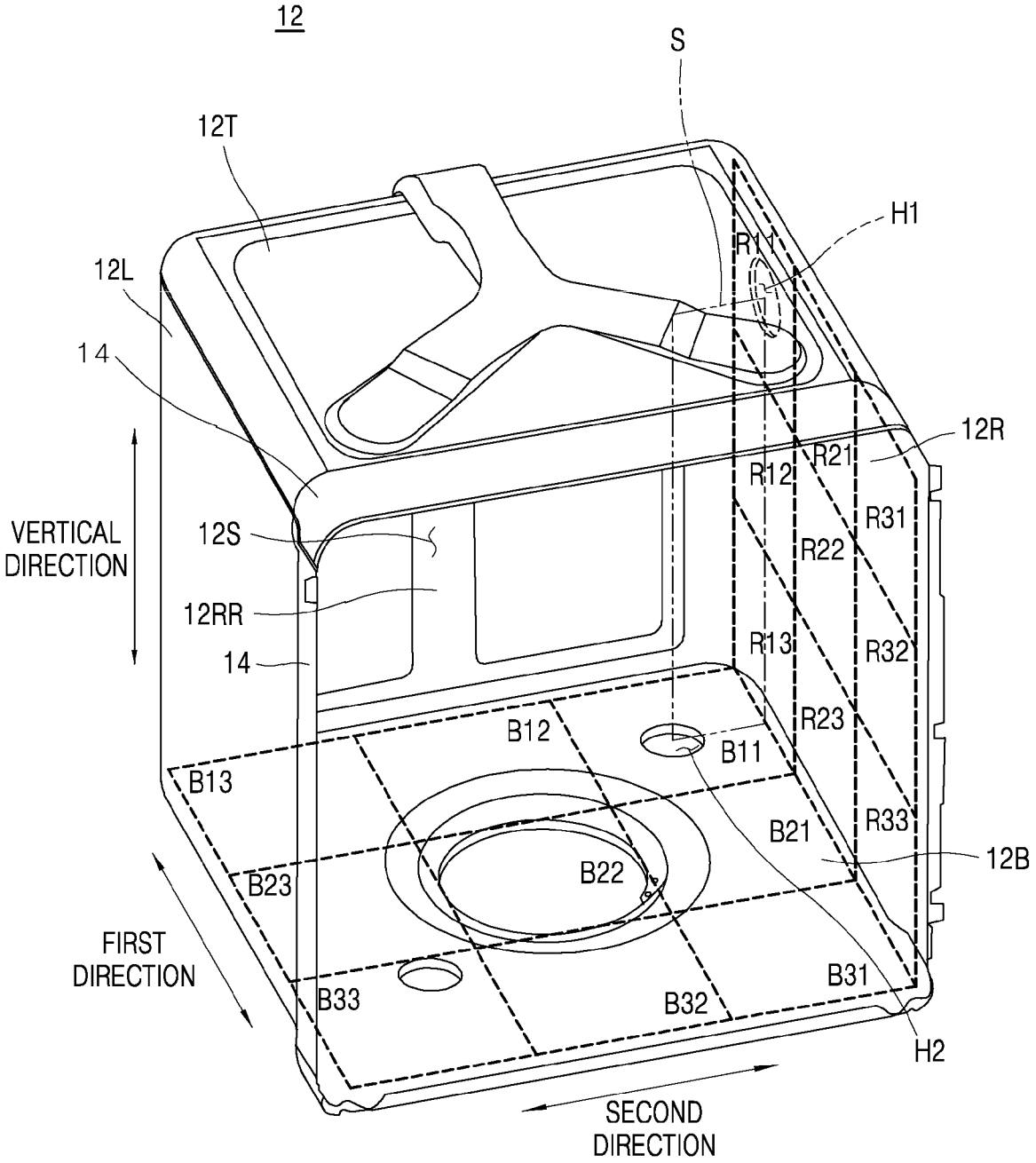
FIG. 2 is a perspective view illustrating an example of a tub.
Figure 5:
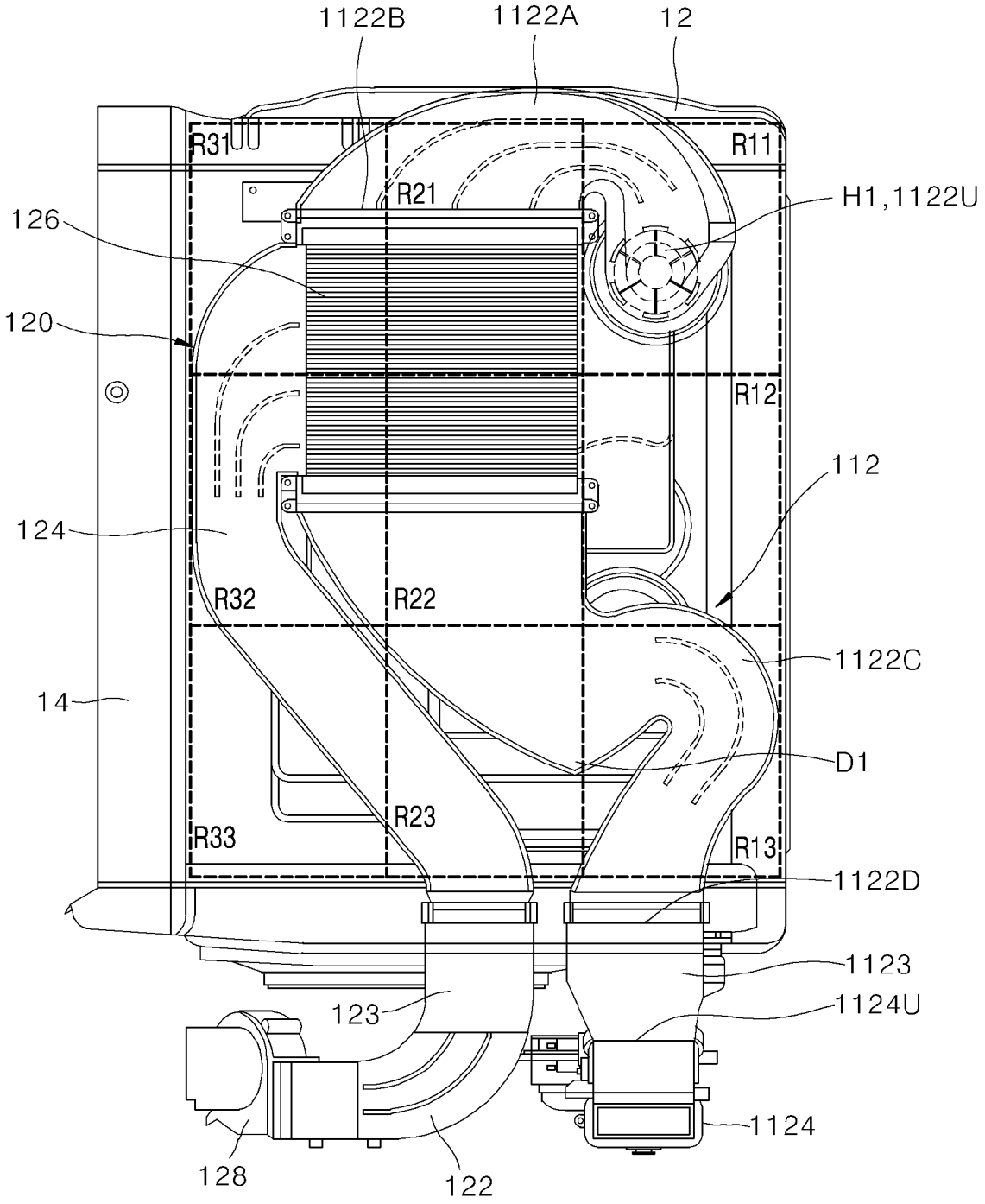
Figure 6:
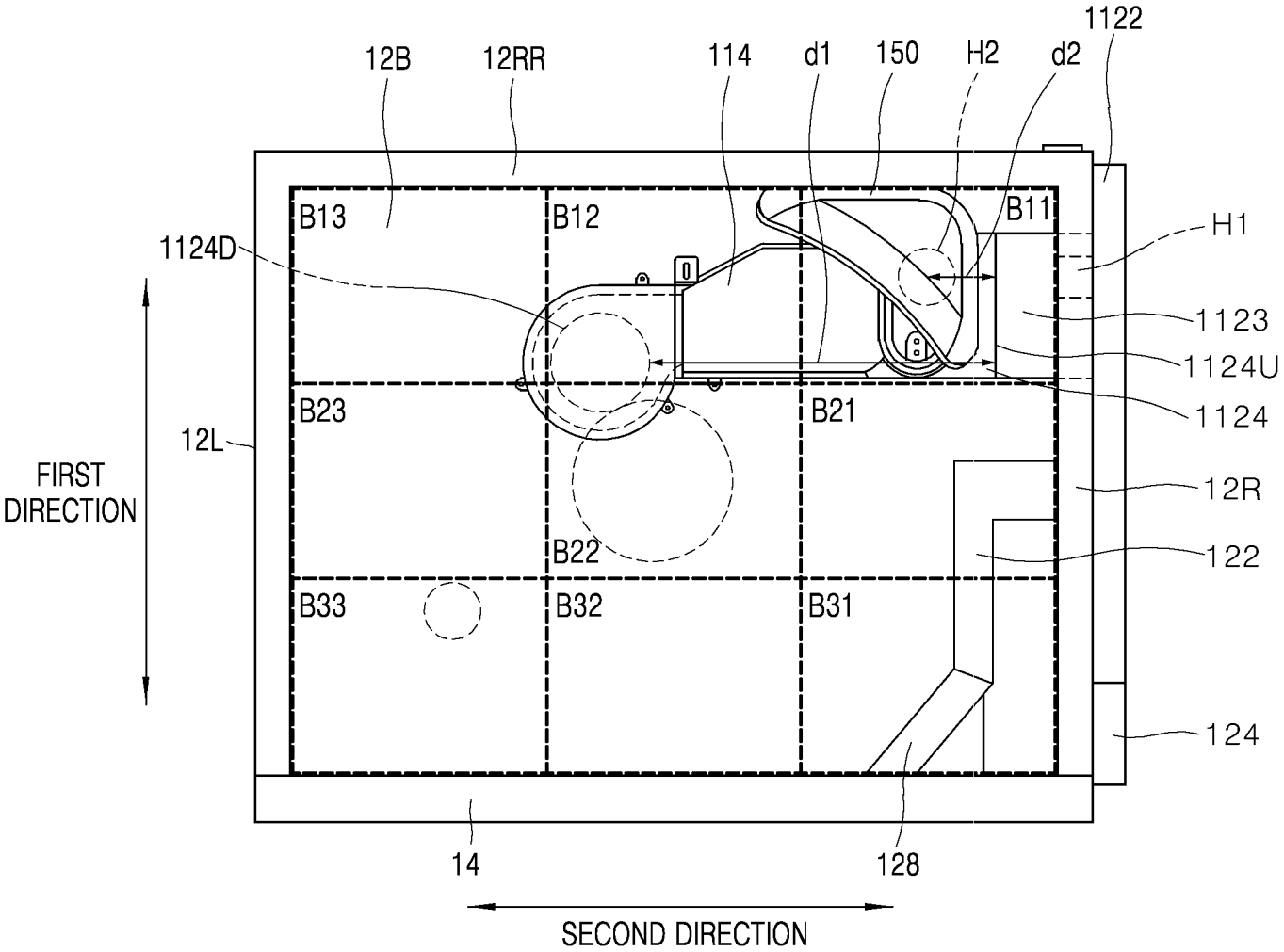
Figure 7:
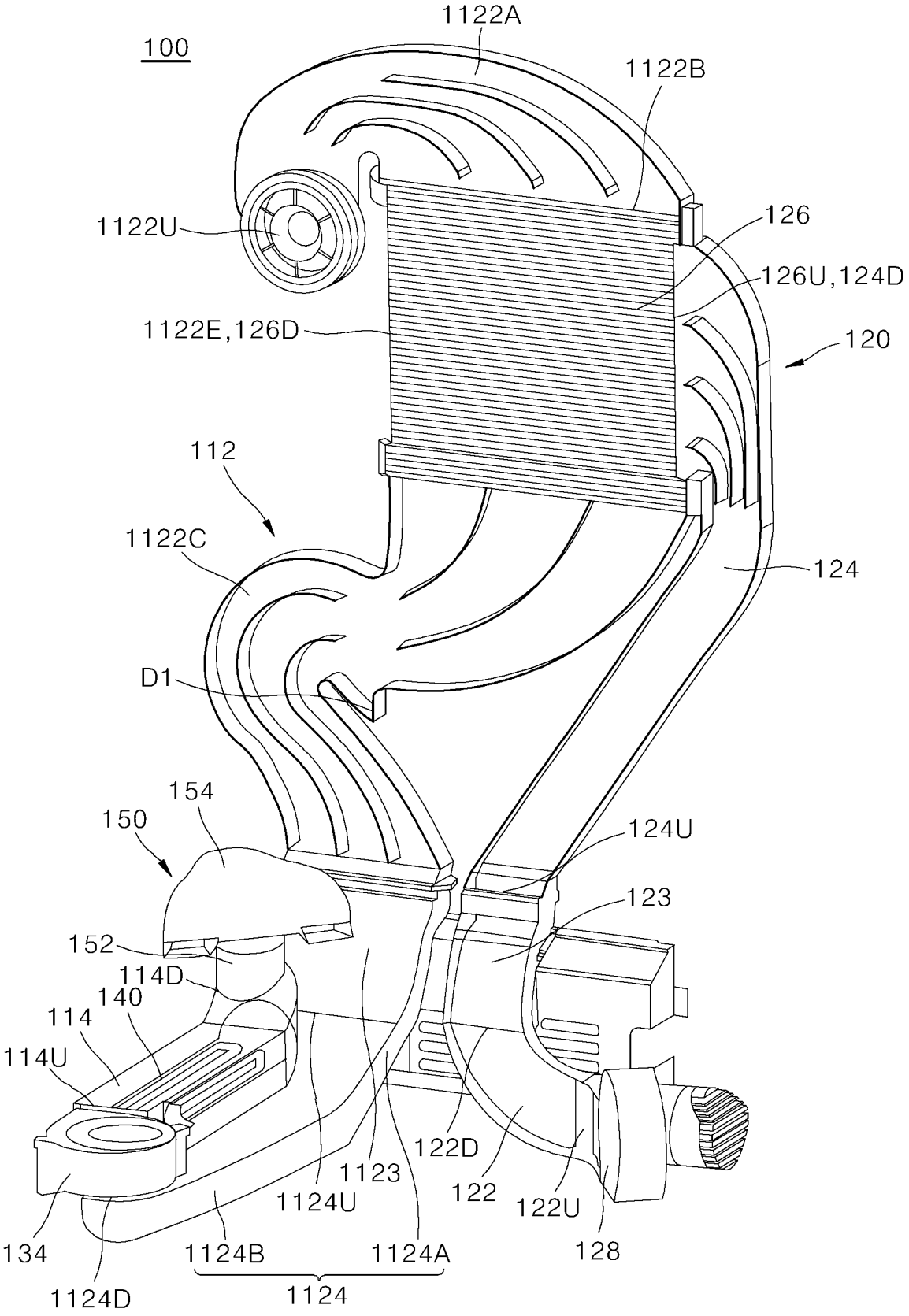
FIG. 7 is a perspective view illustrating an example of a drying device.

FIG. 2 is a perspective view illustrating an example of the tub, FIGS. 3 to 6 are a perspective view, a front view, a side view, and a top plan view illustrating an example of a drying device and the tub, and FIG. 7 is a perspective view illustrating the drying device.

In some implementations, referring to FIG. 2, the tub 12 can include the bottom 12B, an upper wall 12T, a first sidewall 12R, a second sidewall 12L, and the rear wall 12RR. The washing space 12S can be defined in the tub 12 by the bottom 12B, the upper wall 12T, the first sidewall 12R, the second sidewall 12L, and the rear wall 12RR. For example, the first sidewall 12R can be a right sidewall of the tub 12, and the second sidewall 12L can be a left sidewall of the tub 12.

The door 14 for opening or closing the washing space 12S can be disposed at the front side of the tub 12.

The bottom 12B and the upper wall 12T can face each other in the vertical direction, the rear wall 12RR and the door 14 can face each other in the first direction, and one sidewall 12R and the other sidewall 12L can face each other in the second direction.

One sidewall 12R of the tub 12 can be divided into rear portions R11, R12, and R13, central portions R21, R22, and R23, and front portions R31, R32, and R33 in the first direction or the forward/rearward direction. A point at which the rear portion and the central portion of one sidewall 12R are separated can be a point of about ¼ to ⅓ of a width of one sidewall 12R from a rear end to a front side of one sidewall 12R. A point at which the front portion and the central portion of one sidewall 12R are separated can be a point of about ¼ to ⅓ of the width of one sidewall 12R from a front end to a rear side of one sidewall 12R.

In addition, one sidewall 12R of tub 12 can be divided into upper portions R11, R21, and R31, central portions R12, R22, and R32, and lower portions R13, R23, and R33 in the vertical direction or an upward/downward direction. A point at which the upper portion and the central portion of one sidewall 12R are separated can be a point of about ¼ to ⅓ of a height of one sidewall 12R from an upper end to a lower side of one sidewall 12R. A point at which the lower portion and the central portion of one sidewall 12R are separated can be a point of about ¼ to ⅓ of the height of one sidewall 12R from a lower end to an upper side of one sidewall 12R.

Therefore, one sidewall 12R of the tub 12 can be divided into nine regions including a rear upper portion R11, a rear central portion R12, a rear lower portion R13, a central upper portion R21, a central portion R22, a central lower portion R23, a front upper portion R31, a front central portion R32, and a front lower portion R33 in the first direction and the vertical direction.

Like one sidewall 12R, the bottom 12B of the tub 12 can also be divided into nine regions including one rear side portion B11, a rear central portion B12, the other rear side portion B13, one central side portion B21, a central portion B22, the other central side portion B23, one front side portion B31, a front central portion B32, and the other front side portion B33 in the first direction and the second direction.

The inlet port H1 through which the air in the washing space 12S is introduced into the drying duct 110 can be formed in the rear upper portion R11 of one sidewall 12R of the tub 12. In addition, the outlet port H2 through which the air in the drying duct 110 is discharged to the washing space 12S can be formed in one rear side portion B11 of the bottom 12B of the tub 12.

Therefore, since both the outlet port H2 and the inlet port H1 are formed in one rear side of the tub 12, a horizontal distance between the outlet port H2 and the inlet port H1 can decrease. In addition, since the outlet port H2 is formed in the bottom 12B and the inlet port H1 is formed in the upper portion of one sidewall 12R, a vertical distance between the outlet port H2 and the inlet port H1 can increase.

In some examples, to introduce the air into the specific space and allow the introduced air to effectively circulate in the space, i) the air introduced into the inlet port can be restricted from flowing directly to the outlet port, and ii) the horizontal distance between the air inlet port and the outlet port can be decreased, and the vertical distance between the inlet port and the outlet port can be increased.

As described above, since the condition ii) is satisfied, the dry air introduced into the washing space 12S through the outlet port H2 can effectively circulate everywhere in the washing space 12S until the dry air is introduced into the drying device 100 through the inlet port H1, thereby improving the drying efficiency. In some examples, the condition i) can be provided by the distributor 150.

In addition, since both the outlet port H2 and the inlet port H1 are formed at the rear side of the tub 12, the drying duct 110 can be disposed at the periphery of the rear side of the tub 12, and a cold air supply module 120 can be disposed at the periphery of the front side of the tub 12. The periphery of the rear side of the tub 12 can be blocked approximately by the wall, and the periphery of the front side of the tub 12 (particularly, the front space lower than the tub) is opened forward, such that a temperature of the air at the periphery of the front side of the tub 12 can be lower. Therefore, the cold air supply module 120 can effectively reduce humidity of the air in the drying duct 110 by using the cold air at the periphery of the front side of the tub 12, thereby improving the drying performance.

In addition, since the outlet port H2 is formed at the rear side of the tub 12, the distributor 150 of the drying device 100 can be disposed at the rear side of the tub 12. Therefore, when the door 14 disposed at the front side of the tub 12 is opened, the distributor 150 of the drying device 100 does not obstruct a visual field. Therefore, it can be possible to improve the aesthetic appearance and easily manage various types of devices in the tub 12 without being hindered by the distributor 150 of the drying device 100.

The outlet port H2 can meet an imaginary vertical surface S that passes through the inlet port H1 and extends in the second direction and the vertical direction. For example, a center of the outlet port H2 can meet the imaginary vertical surface S that passes through a center of the inlet port H1 and extends in the second direction. The configuration in which the outlet port H2 meets the vertical surface S will be described below.

The outlet port H2, which has a minimum value of the horizontal distance from the inlet port H1 among the outlet ports H2 formed in the bottom 12B and spaced apart from one side end of the bottom 12B toward the other side (the other side in the second direction) by a particular distance, is the outlet port H2 that meets the imaginary vertical surface S.

When the outlet port H2 meets the vertical surface S, the horizontal distance between the outlet port H2 formed in the bottom 12B of the tub 12 and the inlet port H1 formed in one sidewall 12R of the tub 12 can be minimized, so the condition ii) cab be partially provided. Therefore the dry air introduced into the washing space 12S through the outlet port H2 can effectively circulate everywhere in the washing space 12S until the dry air is introduced into the drying device 100 through the inlet port H1. Therefore, the drying efficiency can be further improved.

Further referring to FIGS. 3 to 7, the drying device 100 can include the drying duct 110, the cold air supply module 120, a fan 130, a heater 140, and the distributor 150. However, the cold air supply module 120 and the distributor 150 can be omitted from the drying device 100. The respective components will be described.

The drying duct 110 communicates with the inlet port H1 and the outlet port H2 and is disposed outside the tub 12. The drying duct 110 can include the condensing duct 112 and a return duct 114.

Therefore, because the condensing duct 112 adjoins low-temperature outside air outside the tub 12, moisture vapor contained in the air flowing along the condensing duct 112 is condensed into water and then removed. Therefore, the drying performance can be improved by the simple structure and at low cost.

The condensing duct 112 can include the first condensing duct 1122 and a second condensing duct 1124.

The first condensing duct 1122 can be disposed on one sidewall 12R. Specifically, the first condensing duct 1122 can face or adjoin the outer surface or the outer circumferential surface of one sidewall 12R. An upstream end 1122U of the first condensing duct 1122 can communicate with the inlet port H1.

Therefore, the condensing duct 112 adjoins the low-temperature air outside one sidewall 12R the tub 12, such that the moisture vapor contained in the air flowing along the condensing duct 112 is condensed into water and then removed. Therefore, the drying performance can be improved by the simple structure and at low cost.

Specifically, for example, the first condensing duct 1122 can include a first upstream duct 1122A, a heat exchange duct 1122B, and a first downstream duct 1122C sequentially disposed along the flow direction of the air (FIGS. 5 and 7). The first upstream duct 1122A, the heat exchange duct 1122B, and the first downstream duct 1122C can be three duct sections of the first condensing duct 1122.

The first upstream duct 1122A can communicate with the inlet port H1, and the air can be introduced into the first upstream duct 1122A.

The heat exchange duct 1122B can adjoin the cold air supply module 120.

The first downstream duct 1122C can communicate with the second condensing duct 1124 and discharge the air to the second condensing duct 1124.

A first water drain port D1 can be formed in the first downstream duct 1122C. Therefore, the water introduced through the inlet port H1 or the water condensed in the heat exchange duct 1122B can be discharged to the outside through the first water drain port D1, thereby improving the drying performance of the drying device 100.

A suction fan can be provided at the upstream end 1122U or the periphery of the upstream end 1122U of the first condensing duct 1122. The suction fan can be a centrifugal fan. The suction fan can improve the drying performance by allowing the air to smoothly flow. Since the centrifugal fan is provided, a transverse width (i.e. width in the second direction in the drawings) of the first condensing duct 1122 can be minimized, thereby miniaturizing the dishwasher 1.

A downstream end 1122D of the first condensing duct 1122 can be positioned in the vicinity of a lower end of the rear portion of one sidewall 12R of the tub 12. In this regard, this configuration will be described.

The cold air supply module 120 related to the first condensing duct 1122 will be described first, and then the second condensing duct 1124 will be described.

The cold air supply module 120 can be disposed outside the tub 12. At least a part of the cold air supply module 120 can adjoin the first condensing duct 1122.

Specifically, for example, the cold air supply module 120 can include a first outside air inflow duct 122, a second outside air inflow duct 124, and a heat exchange flow path part 126 (FIGS. 5 and 7).

The first outside air inflow duct 122 can be disposed lower than the bottom 12B of the tub 12, and outside air can be introduced through an upstream end 122U.

The second outside air inflow duct 124 can face or adjoin an outer surface of one sidewall 12R of the tub 12. An upstream end 124U can communicate with a downstream end 122D of the first outside air inflow duct 122.

The heat exchange flow path part 126 can adjoin the first condensing duct 1122, and an upstream end 126U of the heat exchange flow path part 126 can communicate with a downstream end 124D of the second outside air inflow duct 124.

Figure 9:
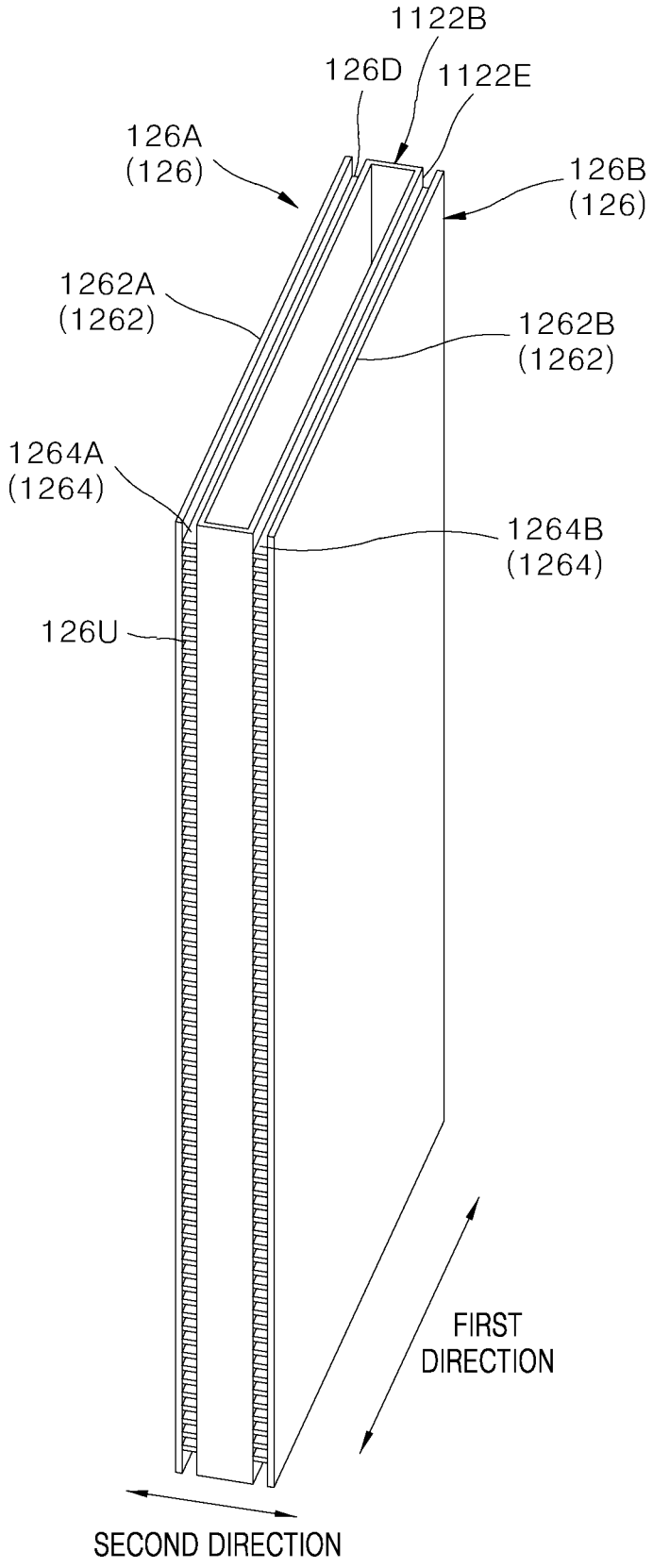
FIG. 9 is a perspective view illustrating examples of a heat exchange duct and a heat exchange flow path part disposed between a first upstream duct and a first downstream duct in the structure illustrated in FIG. 8.

Specifically, for example, the heat exchange flow path part 126 can extend along an outer circumferential surface of the first condensing duct 1122. A downstream end 126D of the heat exchange flow path part 126 can be positioned approximately in parallel in the second direction with an end 1122E in a width direction (the first direction in the drawings) of the first condensing duct 1122 (FIGS. 7 and 9). The air can be discharged to the outside through the downstream end 126D of the heat exchange flow path part 126.

Therefore, the heat exchange flow path part 126 can be configured and the installation space of the heat exchange flow path part 126 can be minimized by the simple configuration and at low cost. In addition, a length of the heat exchange flow path part 126 is decreased, and the flow resistance is reduced, such that the cooling performance can be improved.

The cooling fan 128 can be disposed in the first outside air inflow duct 122 or at the periphery of the upstream end 122U of the first outside air inflow duct 122. The cooling fan 128 can suction the outside air and supply the outside air into the heat exchange flow path part 126.

Therefore, since the cooling fan 128 can be disposed lower than the tub 12, the cooling fan 128 can suction the cold air lower than the tub 12 and supply the cold air to the heat exchange flow path part 126, thereby improving the cooling efficiency. In addition, because the space lower than the tub 12 is comparatively large, it can be possible to improve the cooling efficiency by increasing the size of the cooling fan 128.

In some examples, a first connection duct 123 can be disposed between the first outside air inflow duct 122 and the second outside air inflow duct 124. The first connection duct 123 can communicate with the downstream end 122D of the first outside air inflow duct 122 and the upstream end 124U of the second outside air inflow duct 124 (FIG. 7).

As described above, the dishwasher can further include the cold air supply module 120 disposed outside the tub 12 and configured to at least partially adjoin the first condensing duct 1122. Therefore, the cold air supply module 120 can effectively remove moisture vapor, which is contained in the air flowing along the first condensing duct 1122, by condensing the moisture vapor into the water. Therefore, the drying performance can be improved by the simple structure and at low cost.

In addition, the cold air supply module 120 includes the first outside air inflow duct 122 disposed lower than the bottom 12B of the tub 12 and configured to allow the outside air to be introduced thereinto, the second outside air inflow duct 124 configured to face or adjoin the outer surface or the outer surface of one sidewall 12R of the tub 12, and the heat exchange flow path part 126 configured to adjoin the first condensing duct 1122 and communicate with the second outside air inflow duct 124. Therefore, it can be possible to effectively remove the moisture vapor contained in the air flowing along the first outside air inflow duct 122 by condensing the moisture vapor into water using the cold air lower than the tub 12. Therefore, the drying performance can be improved by the simple structure and at low cost.

The heat exchange flow path part 126 will be described in more detail with reference to FIGS. 8 and 9.

Figure 8:
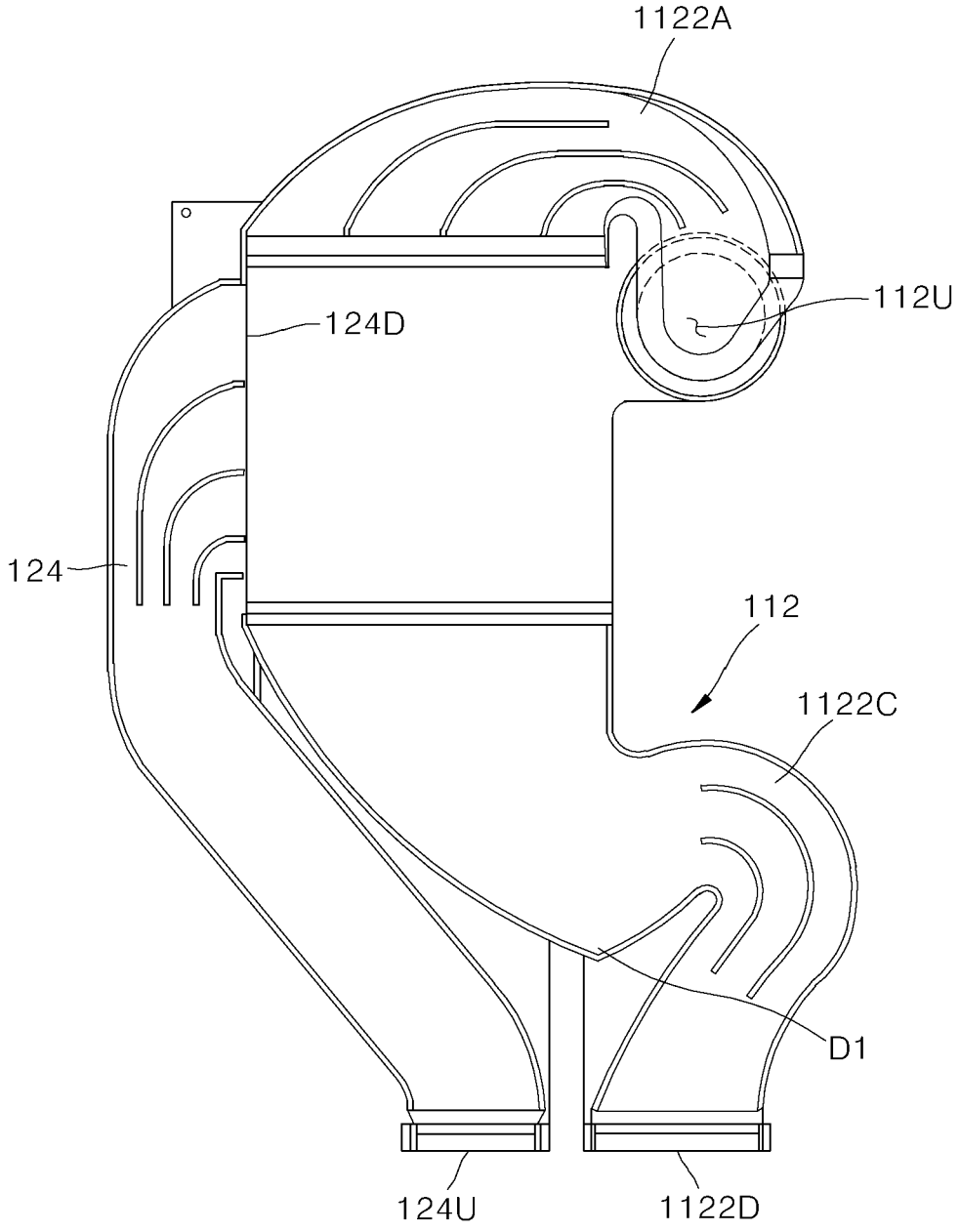
FIG. 8 is a view illustrating example components of the drying device in FIGS. 3 to 7 that are integrally manufactured.

FIG. 8 is a view illustrating example components of the drying device in FIGS. 3 to 7 that are integrally manufactured, and FIG. 9 is a perspective view illustrating examples of a heat exchange duct and a heat exchange flow path part disposed between a first upstream duct and a first downstream duct in the structure illustrated in FIG. 8.

In some implementations, referring to FIG. 8, the first upstream duct 1122A, the first downstream duct 1122C, and the second outside air inflow duct 124 can be integrated. A vacant space can be formed between the first upstream duct 1122A and the first downstream duct 1122C. The heat exchange duct 1122B and the heat exchange flow path part 126, which will be described with reference to FIG. 9, can be installed in the vacant space between the first upstream duct 1122A and the first downstream duct 1122C.

Since the first upstream duct 1122A, the first downstream duct 1122C, and the second outside air inflow duct 124 are integrated as described above, the manufacturing cost of the drying device 100 can be reduced, and the drying device 100 can be easily installed and maintained.

Referring to FIG. 9, the heat exchange duct 1122B and the heat exchange flow path part 126 can be installed between the first upstream duct 1122A and the first downstream duct 1122C in the structure illustrated in FIG. 8.

The heat exchange duct 1122B can have a flat tubular shape opened at two opposite ends thereof and communicate vertically with the first upstream duct 1122A and the first downstream duct 1122C illustrated in FIG. 8.

The heat exchange flow path part 126 can include a plate 1262 and a partition wall 1264.

The plate 1262 can be disposed to face at least one of one surface and the other surface in the second direction of the heat exchange duct 1122B.

The partition wall 1264 can be provided in plural, and the plurality of partition walls 1264 can be disposed in parallel between the plate 1262 and one surface or the other surface in the second direction of the heat exchange duct 1122B.

The plate 1262 and the plurality of partition walls 1264 can extend along the outer circumferential surface of the heat exchange duct 1122B in the width direction (the first direction in the drawings) of the heat exchange duct 1122B that intersects the flow direction of the air flowing in the heat exchange duct 1122B.

When the heat exchange duct 1122B and the heat exchange flow path part 126 illustrated in FIG. 9 are installed in the vacant space between the first upstream duct 1122A and the first downstream duct 1122C of the structure illustrated in FIG. 8, the downstream end 124D of the second outside air inflow duct 124 can adjoin a lateral end in the first direction of the heat exchange duct 1122B and the plate 1262. Therefore, the cold air introduced into the second outside air inflow duct 124 can flow to the vacant space between the plate 1262 and the heat exchange duct 1122B. In this case, a plurality of flow paths can be formed between the plate 1262 and the heat exchange duct 1122B by the plurality of partition walls 1264 extending in the width direction (the first direction in the drawings) of the heat exchange duct 1122B.

That is, the cold air introduced into the second outside air inflow duct 124 can flow along the plurality of flow paths formed by the heat exchange duct 1122B, the plate 1262, and the plurality of partition walls 1264. The direction in which the cold air flows along the plurality of flow paths formed by the heat exchange flow path part 126 can intersect the direction in which the moist air flows along the heat exchange duct 1122B.

In this case, as described above, the downstream end 126D of the heat exchange flow path part 126 can be positioned approximately in parallel in the second direction with the end 1122E in the width direction (the first direction in the drawings) of the first condensing duct 1122 (FIG. 9).

As described above, the heat exchange flow path part 126 includes the plate 1262 disposed to face at least one of one surface and the other surface in the second direction of the heat exchange duct 1122B, and the plurality of partition walls 1264 disposed in parallel between the plate 1262 and one surface or the other surface in the second direction of the heat exchange duct 1122B. Therefore, heat exchange flow path part 126 can be configured by the simple configuration and at low cost. In addition, since the cold air flows along the outer circumferential surface of the heat exchange duct 1122B, the heat exchange efficiency can be improved. In addition, since the cold air flows along the plurality of flow paths separated from one another, the heat exchange is uniformly performed in a wide area, such that the heat exchange efficiency can be improved.

In some examples, as illustrated in FIG. 9, since the heat exchange duct 1122B and the heat exchange flow path part 126 are manufactured separately and then installed between the first upstream duct 1122A and the first downstream duct 1122C of the structure illustrated in FIG. 8, the drying device 100 can be easily manufactured, replaced, and repaired. Therefore, the manufacturing cost can be reduced, and the maintenance can be easily performed.

Figure 10:
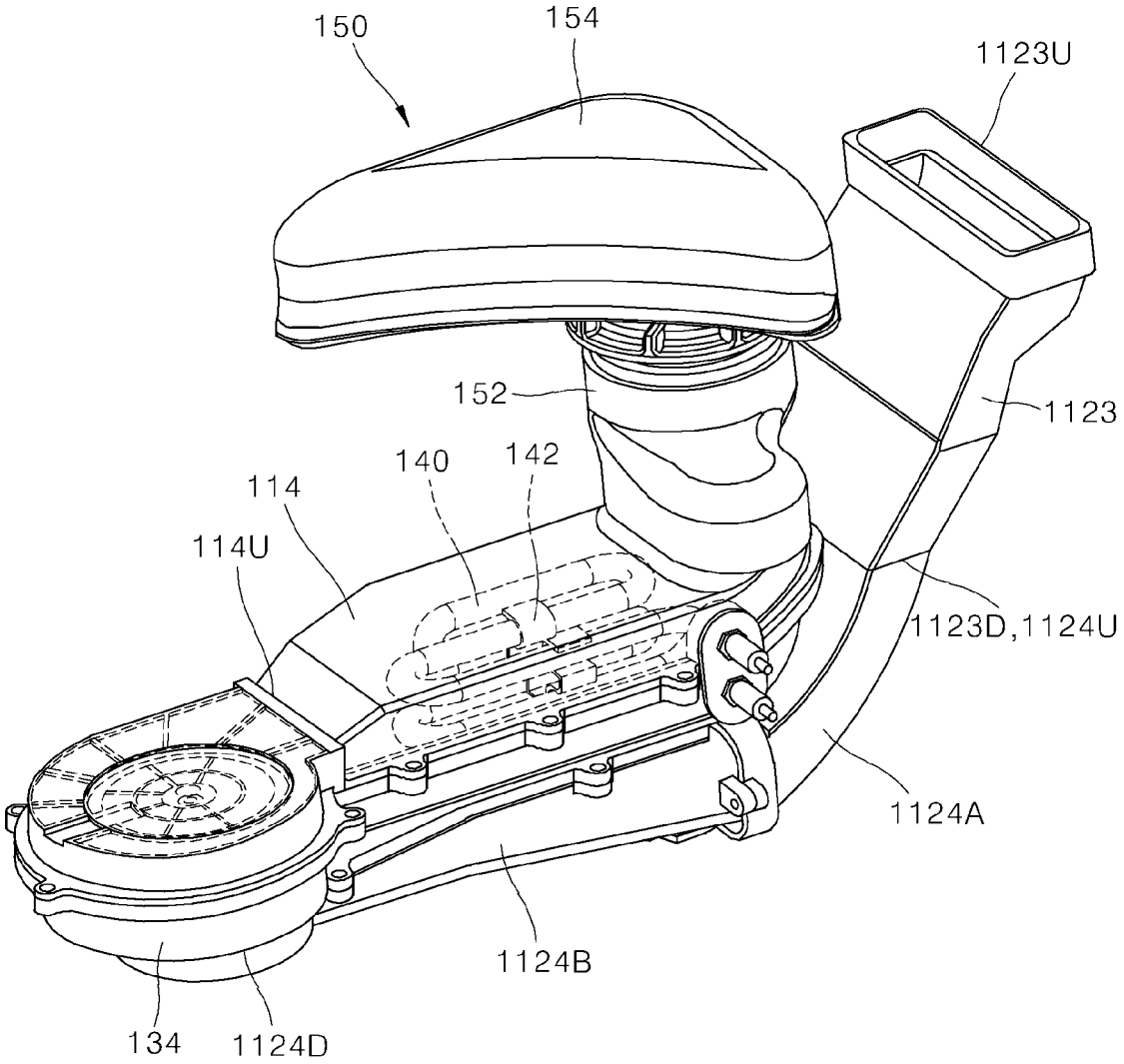
FIG. 10 is a perspective view illustrating examples of a second connection duct, a second condensing duct, a return duct, a fan housing, a heater, and a distributor.
Figure 11:
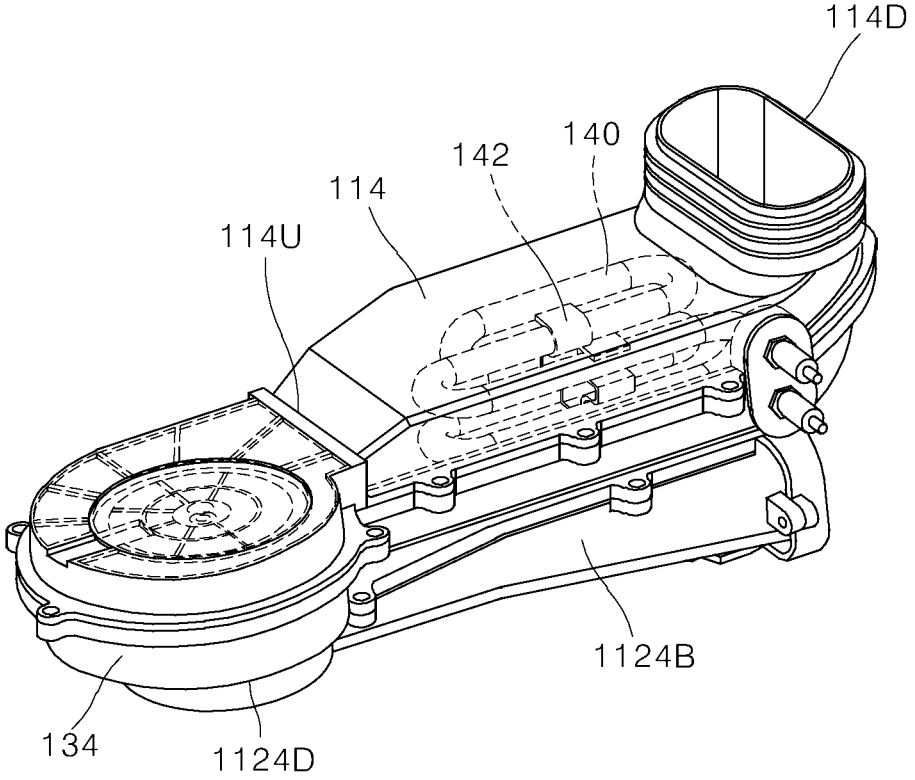
FIGS. 11 to 13 are a perspective view, a top plan view, and a cross-sectional view illustrating a second downstream duct, the return duct, the fan housing, and the heater.
Figure 12:
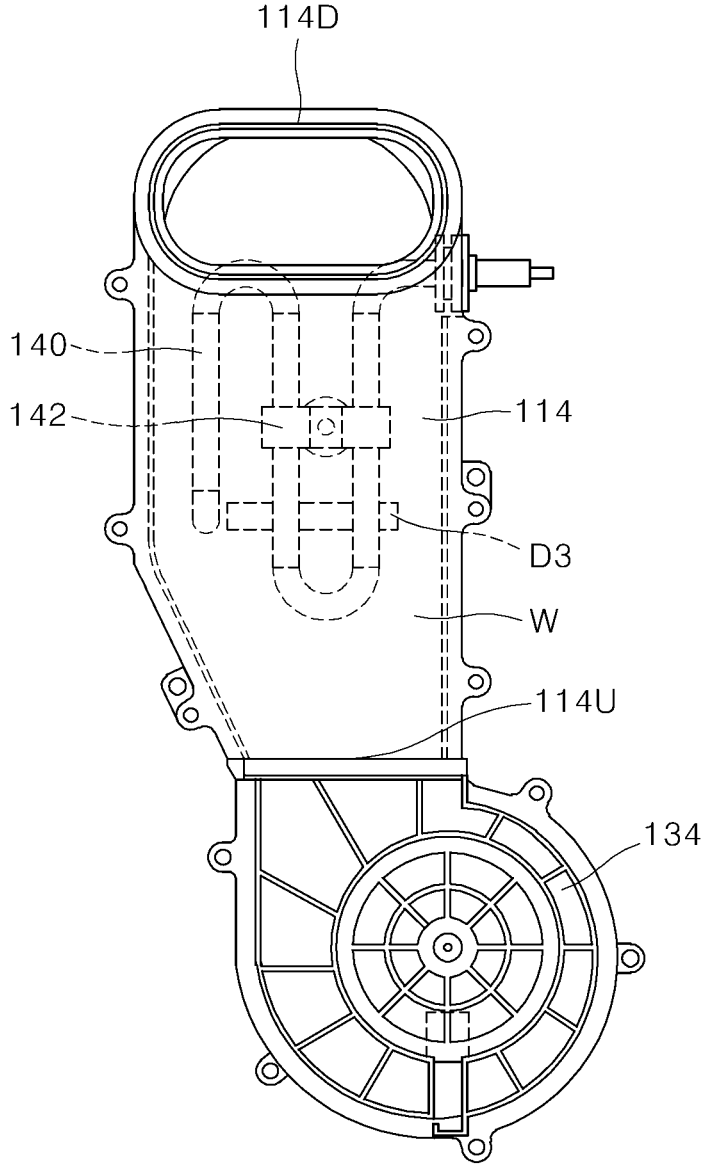
Figure 13:
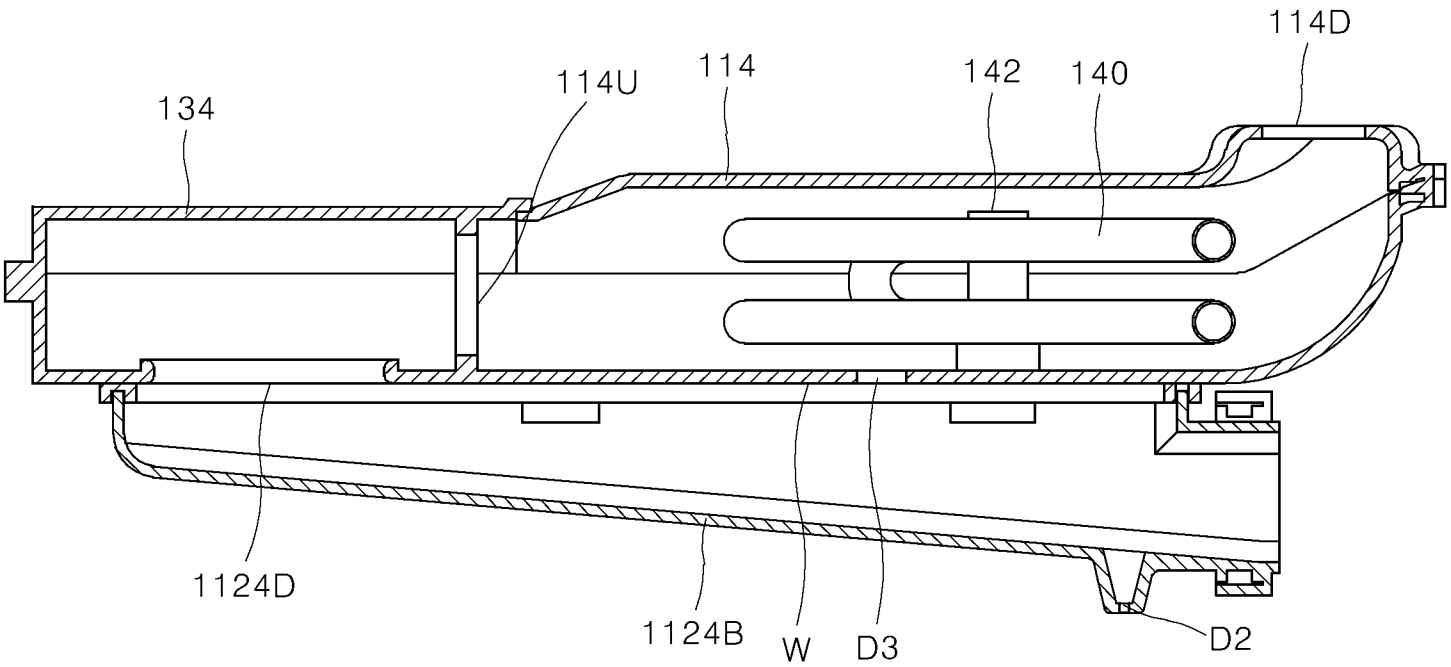
Figure 14:
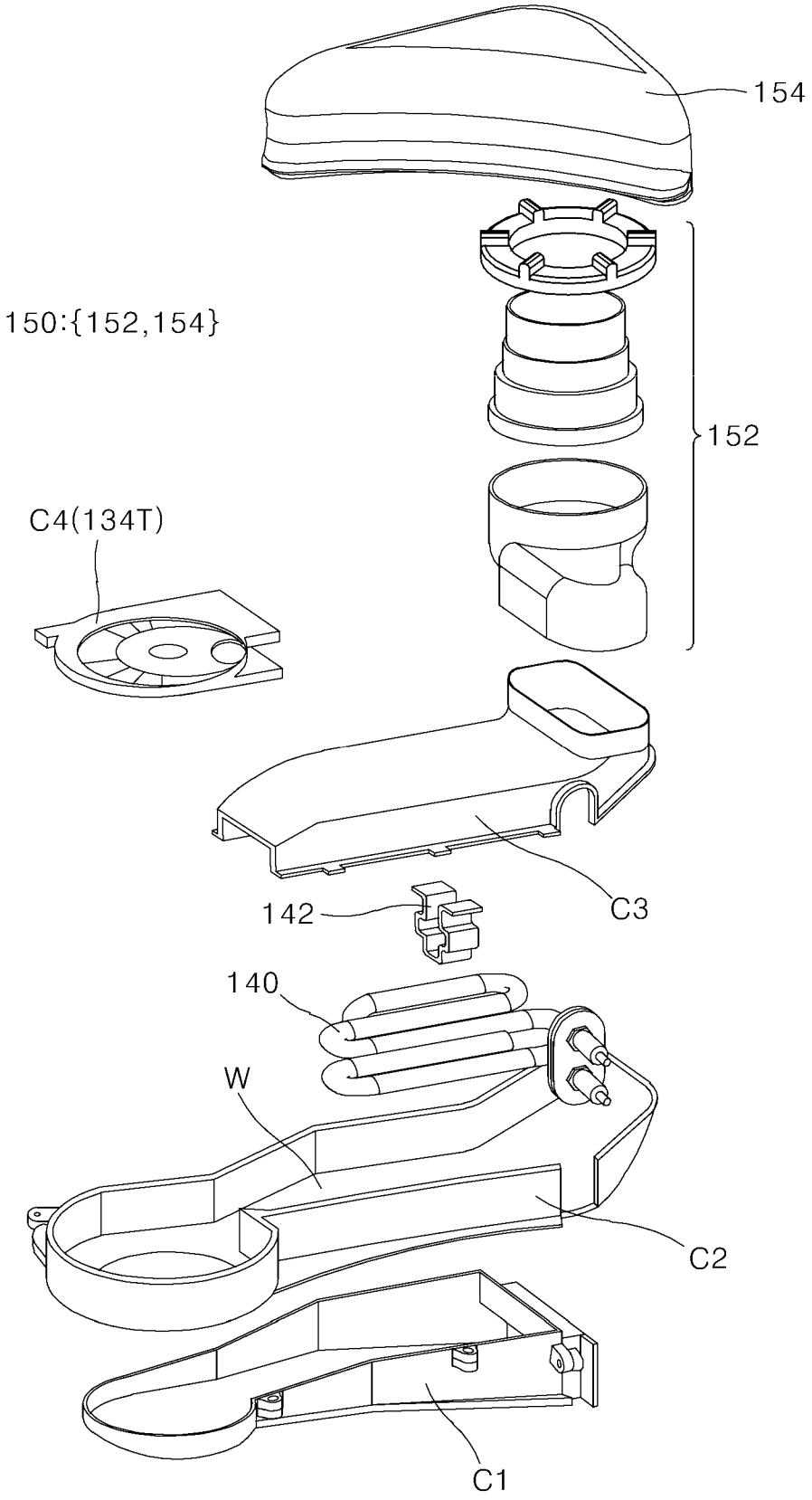
FIG. 14 is an exploded perspective view illustrating the second downstream duct, the return duct, the fan housing, the heater, and the distributor.
Figure 15:
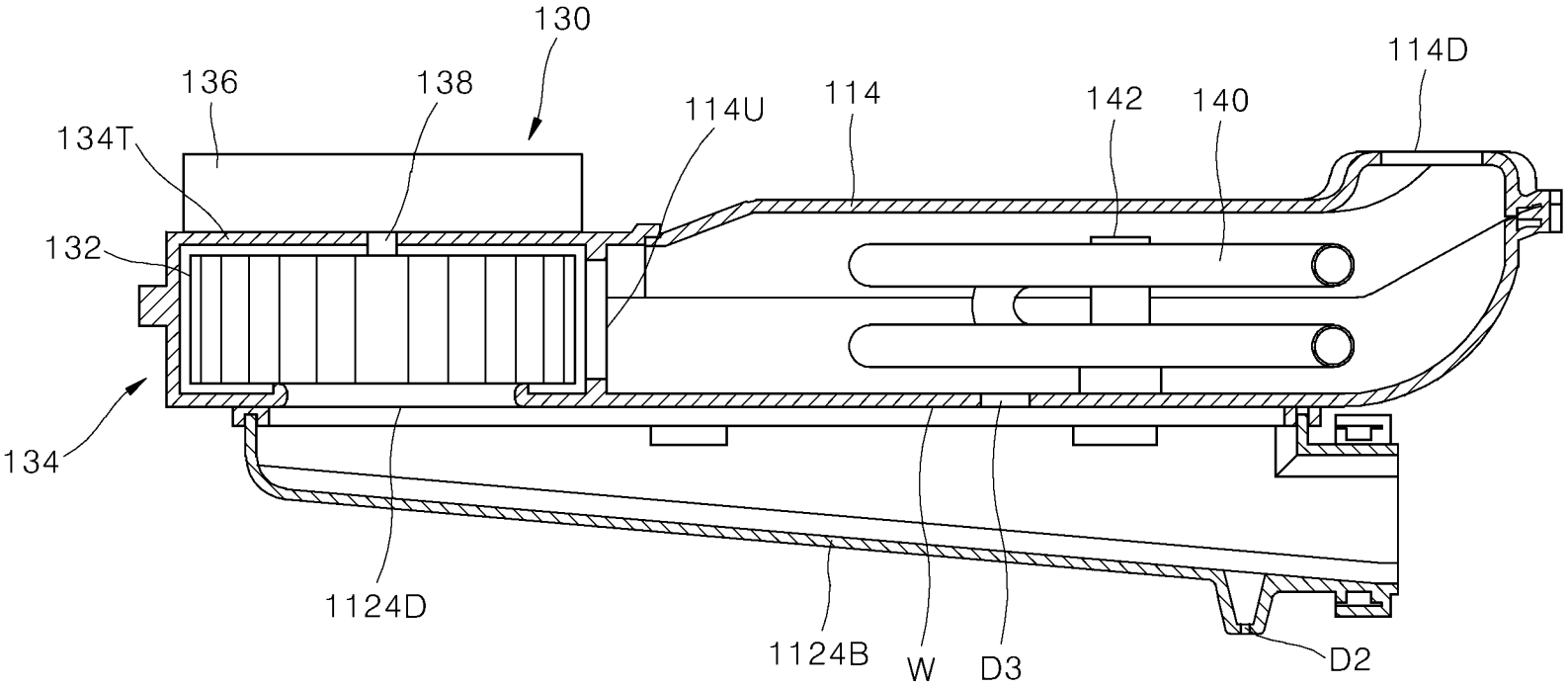
FIG. 15 is a cross-sectional view illustrating examples of a fan blade and a motor that are installed in the fan housing illustrated in FIG. 13.

FIG. 10 is a perspective view illustrating examples of a second connection duct, a second condensing duct, a return duct, a fan housing, a heater, and a distributor, and FIGS. 11 to 13 are a perspective view, a top plan view, and a cross-sectional view illustrating examples of a second downstream duct, the return duct, the fan housing, and the heater. FIG. 14 is an exploded perspective view illustrating examples of the second downstream duct, the return duct, the fan housing, the heater, and the distributor. FIG. 15 is a cross-sectional view illustrating examples of a fan blade and a motor that are installed in the fan housing illustrated in FIG. 13.

Further referring to FIGS. 10 to 15, the second condensing duct 1124 can be disposed lower than the bottom 12B of the tub 12. An upstream end 1124U of the second condensing duct 1124 can communicate with the downstream end 1122D of the first condensing duct 1122 (FIGS. 5 and 7).

Therefore, the condensing duct 112 adjoins the low-temperature air lower than the bottom 12B of the tub 12, such that the moisture vapor contained in the air flowing along the condensing duct 112 is condensed into water and then removed. Therefore, the drying performance can be improved by the simple structure and at low cost.

Specifically, for example, the second condensing duct 1124 can include a second upstream duct 1124A and a second downstream duct 1124B sequentially disposed along the flow direction of the air (FIGS. 7 and 10). The second upstream duct 1124A and the second downstream duct 1124B can be two duct sections of the second condensing duct 1124.

The second upstream duct 1124A can communicate with the downstream end 1122D of the first condensing duct 1122 (FIGS. 5, 7, and 10). The second upstream duct 1124A can be inclined approximately downward along the flow direction of the air.

The second downstream duct 1124B can communicate with the return duct 114. The second downstream duct 1124B can be approximately parallel to the horizontal plane or inclined upward along the flow direction of the air.

However, the present disclosure is not limited to this configuration. For example, the second condensing duct 1124 can be configured to include only a section parallel to the horizontal plane or inclined upward like the second downstream duct 1124B. In this case, the second downstream duct 1124B can be the second condensing duct 1124.

The second condensing duct 1124 can be bent in the vicinity of a downstream end 1124D and extend in an approximately vertical direction (e.g., upward). Therefore, it can be possible to help to prevent the water, which is introduced into the second condensing duct 1124 or produced in the second condensing duct 1124, from being introduced into the return duct 114.

The horizontal straight distance d1 between the upstream end 1124U and the downstream end 1124D of the second condensing duct 1124 can be longer than a horizontal straight distance d2 between the upstream end 1124U of the second condensing duct 1124 and the outlet port H2 (FIG. 6). For example, in the second direction, the downstream end 1124D of the second condensing duct 1124 can be located beyond a midpoint of the bottom 12B of the tub 12 (FIG. 6).

Therefore, even though the outlet port H2 is formed in the vicinity of the inlet port H1 in the horizontal direction to improve the drying performance, a horizontal length of the return duct 114 communicating with the outlet port H2 and the downstream end 1124D of the second condensing duct 1124 can increase, and a distance between the downstream end 1124D of the second condensing duct 1124 and the upstream end 114U of the return duct 114 can increase. Therefore, a heater 350 having a sufficiently large size can be disposed inside or outside the return duct 114, and the fan 130 can be disposed between the downstream end 1124D of the second condensing duct 1124 and the upstream end 114U of the return duct 114. Therefore, the drying performance of the dishwasher 1 can be improved by the simple configuration, and the dishwasher 1 can have a compact structure having a small size.

Figure 3:
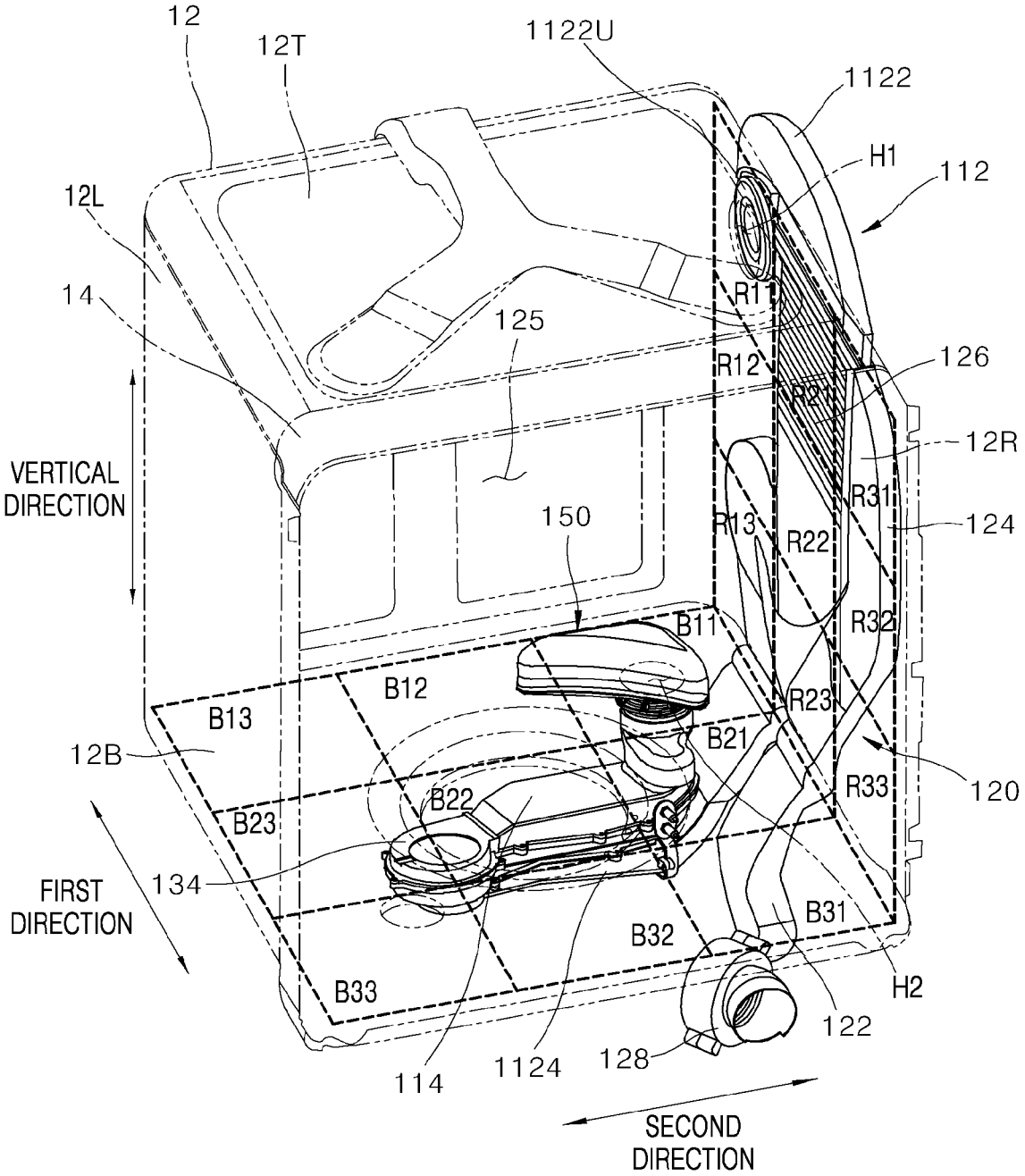
FIGS. 3 to 6 are a perspective view, a front view, a side view, and a top plan view illustrating an example of a drying device and the tub.
Figure 4:
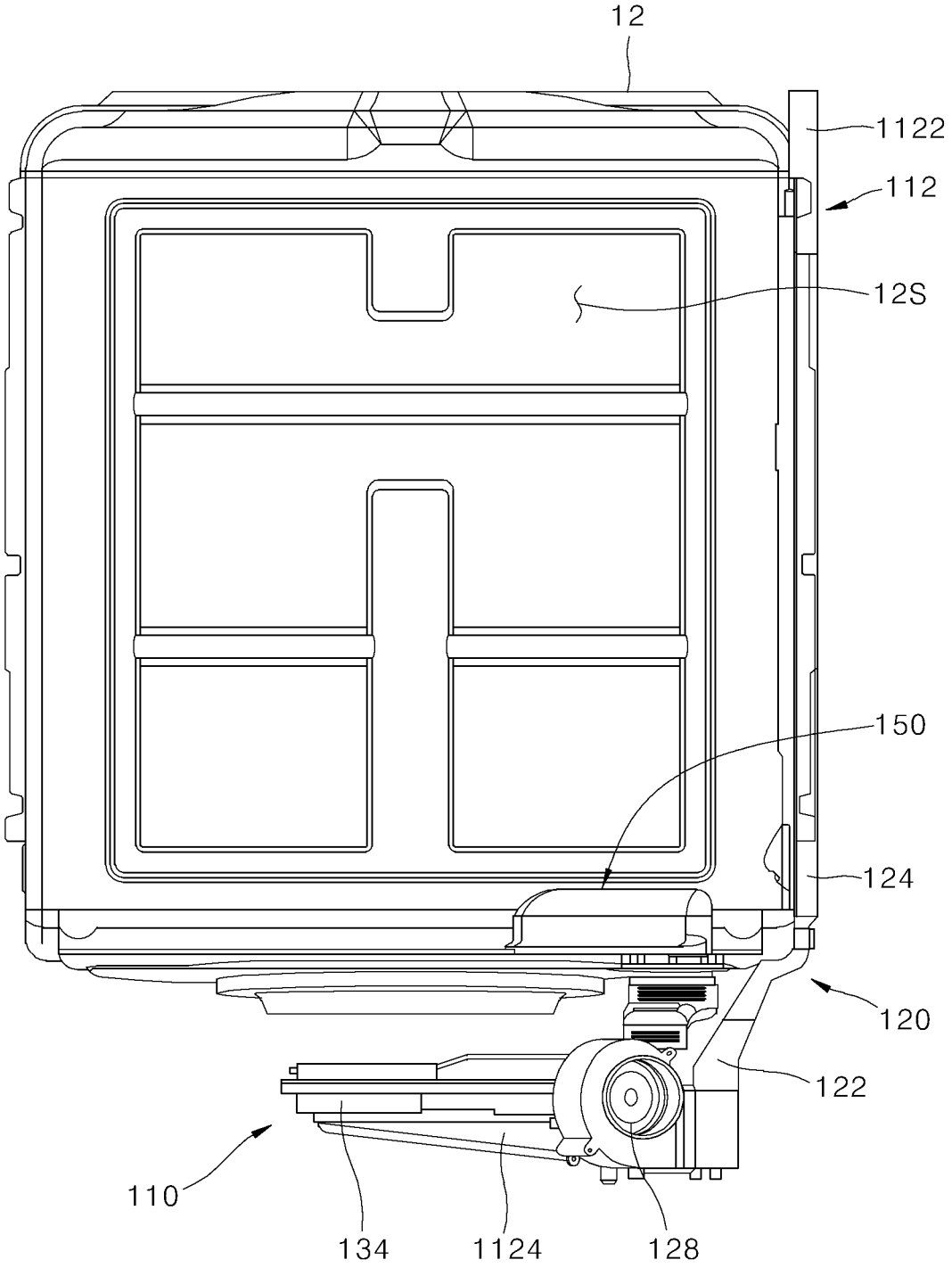

As described above, the downstream end 1122D of the first condensing duct 1122 can be positioned in the vicinity of the lower end of the rear portion of one sidewall 12R of the tub 12, and the upstream end 1124U of the second condensing duct 1124 can be positioned in the vicinity of one side end of the rear portion of the bottom 12B of the tub 12 (FIGS. 3, 5, and 7). For example, the downstream end 1122D of the first condensing duct 1122 may be positioned adjacent to the rear lower portion R13 of one sidewall 12R of the tub 12 and the upstream end 1124U of the second condensing duct 1124 may be positioned adjacent to the one rear side portion B11 of bottom 12B of the tub 12. For example, the downstream end 1122D of the first condensing duct 1122 may be positioned closest to rear lower portion R13 among the nine regions R11 to R33 of one sidewall 12R of the tub 12 (FIG. 2 or 3), thereby being positioned in the vicinity of the lower end of the rear portion of one sidewall 12R. And the upstream end 1124U of the second condensing duct 1124 may be positioned closest to one rear side portion B11 among the nine regions B11 to B33 of bottom 12B of the tub 12 (FIG. 2 or 3), thereby being positioned in the vicinity of one side end of the rear portion of bottom 12B. Therefore, since both the downstream end 1122D of the first condensing duct 1122 and the upstream end 1124U of the second condensing duct 1124 are positioned at the rear side together with the inlet port H1 and the outlet port H2, the condensing duct 112 can be formed in a shape similar to a straight line, and the length of the condensing duct 112 can decrease. Therefore, the flow resistance can be reduced, and the drying performance can be improved.

The second condensing duct 1124 can have a second water drain port D2 (FIG. 13). Therefore, the water introduced through the inlet port H1 or the outlet port H2 or the water condensed in the condensing duct 112 can be discharged to the outside through the second water drain port D2, thereby improving the drying performance of the drying device 100.

In some examples, a second connection duct 1123 can be disposed between the first condensing duct 1122 and the second condensing duct 1124. The second connection duct 1123 can communicate with the downstream end 1122D of the first condensing duct 1122 and the upstream end 1124U of the second condensing duct 1124 (FIGS. 5 and 7).

As described above, the condensing duct 112 includes: the first condensing duct 1122 facing the outer surface of one sidewall 12R of the tub 12 and having the upstream end communicating with the inlet port H1; and the second condensing duct 1124 disposed lower than the bottom 12B of the tub 12 and having the upstream end communicating with the downstream end of the first condensing duct 1122. Therefore the condensing duct 112 adjoins the low-temperature air outside of one sidewall 12R of the tub 12 and lower than the bottom 12B of the tub 12 such that the moisture vapor contained in the air flowing along the condensing duct 112 is condensed into water and removed. Therefore, the drying performance can be improved by the simple structure and at low cost.

The upstream end 114U of the return duct 114 can communicate with the downstream end 1124D of the second condensing duct 1124, and a downstream end 114D of the return duct 114 can communicate with the outlet port H2.

For example, the downstream end 114D of the return duct 114 can communicate with the distributor 150 that is inserted into the washing space 12S through the outlet port H2 and discharges the air into the washing space 12S.

The second condensing duct 1124 and the return duct 114 can be positioned only under rear portions B11, B12, and B13 of the bottom 12B of the tub 12. Therefore, since the second condensing duct 1124 and the return duct 114 are positioned at the rear side together with the outlet port H2 and the inlet port H1, the second condensing duct 1124 and the return duct 114 can be formed in a shape similar to a straight line, and the lengths of the ducts 1124, and 114 can decrease. Therefore, the flow resistance can be reduced, and the drying performance can be improved. In addition, the dishwasher 1 can have a compact structure having a small size.

The return duct 114 can be positioned between the bottom 12B of the tub 12 and the second condensing duct 1124. For example, at least a part of the return duct 114 can be disposed under the bottom 12B of the tub 12, and the part of the return duct 114 and the second condensing duct 1124 can be disposed vertically.

That is, at least a part of the return duct 114 can be disposed higher than the second condensing duct 1124.

Therefore, it can be possible to help to prevent the water introduced into the second condensing duct 1124 through the inlet port H1 and the water condensed in the condensing duct 112 from being introduced into the return duct 114. Therefore, it can be possible to help to prevent the water in the condensing duct 112 from being introduced into the washing space 12S through the outlet port H2 communicating with the return duct 114, thereby improving the drying performance. That is, the drying performance can be improved by reducing or preventing the water from flowing reversely.

The return duct 114 and the second condensing duct 1124 can at least partially adjoin each other in the longitudinal direction of the return duct 114 and the second condensing duct 1124. At the portion where the return duct 114 and the second condensing duct 1124 adjoin each other, the return duct 114 and the second condensing duct 1124 can be separated by a separation wall W disposed in the longitudinal direction of the return duct 114 and the second condensing duct 1124 (FIGS. 12 to 15).

Therefore, the return duct 114 and the second condensing duct 1124 can be easily manufactured by the simple configuration and at low cost. In addition, since the return duct 114 and the second condensing duct 1124 are separated by the single separation wall W, a part of heat generated from the heater 140 disposed in the return duct 114 can be easily transferred to the second condensing duct 1124. Therefore, a small amount of water in the second condensing duct 1124 is vaporized by the heat transferred to the second condensing duct 1124, and thus the humidity in the second condensing duct 1124 decreases, which makes it possible to reduce or prevent the proliferation of bacteria or mold in the second condensing duct 1124.

The return duct 114 can have a third water drain port D3 (FIG. 13). Therefore, the water introduced through the outlet port H2 and the water condensed in the return duct 114 can be discharged to the outside of the return duct 114 through the third water drain port D3, thereby improving the drying performance of the drying device 100. In this case, the outside of the return duct 114 can be the inside of the second condensing duct 1124 (FIG. 13).

The fan 130 can be disposed between the downstream end 1124D of the condensing duct 112 and the downstream end 114D of the return duct 114. For example, the fan 130 can be disposed between the second condensing duct 1124 and the return duct 114.

Therefore, the fan 130 can help to prevent the occurrence of vortex and allow the air to smoothly flow in a downstream portion (e.g., between the condensing duct and the return duct) of the drying duct 110 where the flow direction of the air is considerably changed. Therefore, flow resistance is not increased, which makes it possible to improve the drying performance of the drying device 100.

The fan 130 can communicate with the second condensing duct 1124 (FIG. 15). For example, the fan 130 can communicate downwardly with the downstream end 1124D of the second condensing duct 1124.

In addition, the fan 130 can communicate with the return duct 114 (FIG. 15). For example, the fan 130 can communicate laterally with the upstream end 114U of the return duct 114.

The fan 130 can be disposed higher than the downstream end 1124D of the second condensing duct 1124 (FIG. 15).

Therefore, it can be possible to help to prevent a motor 136 of the fan 130 from coming into contact with the water introduced into the condensing duct 112 or the water condensed in the condensing duct 112. Therefore, it can be possible to help to prevent the water from being introduced into the motor 136 of the fan 130 and thus help to prevent the fan 130 from being broken down, thereby improving the durability and stability of the drying device 100.

The fan 130 can allow the air to flow in the drying duct 110. Specifically, for example, the fan 130 can introduce the air in the first condensing duct 1122 into the second condensing duct 1124. In addition, the fan 130 can introduce the air in the second condensing duct 1124 into the return duct 114. In addition, the fan 130 can discharge the air in the return duct 114 into the washing space 12S through the outlet port H2 and the distributor 150 to be described below.

The fan 130 can include a fan blade 132, a fan housing 134, and the motor 136.

The fan blade 132 can be fixedly coupled to a rotary shaft 138 and rotated by the motor 136. The fan blade 132 can be accommodated in the fan housing 134.

The fan housing 134 can communicate with the downstream end 1124D of the second condensing duct 1124 and the upstream end 114U of the return duct 114.

For example, the fan housing 134 can have a through-hole formed in a lower surface thereof and communicate downwardly with the downstream end 1124D of the second condensing duct 1124 (FIG. 15). In addition, the fan housing 134 can have a through-hole formed in a lateral surface thereof and communicate laterally with the upstream end 114U of the return duct 114 (FIG. 15).

The fan housing 134 can include an upper wall 134T. The upper wall 134T can be disposed between the fan blade 132 and the motor 136 disposed above the fan blade 132.

Therefore, even though the fan blade 132 comes into contact with the water introduced into the return duct 114 through the outlet port H2, the water being in contact with the fan blade 132 is blocked by the upper wall 134T, such that the water cannot come into contact with the motor 136. Therefore, it can be possible to help to prevent the water from being introduced into the motor 136 and thus help to prevent the fan 130 from being broken down, thereby improving the durability and stability of the drying device 100.

The upper wall 134T can have a hole penetrated by the rotary shaft 138.

The motor 136 can be coupled to the fan blade 132 by means of the rotary shaft 138. The motor 136 can rotate the fan blade 132.

The motor 136 can be disposed above the fan blade 132. In addition, the motor 136 can be disposed on the upper wall 134T.

The rotary shaft 138 of the fan 130 can extend in an approximately vertical direction.

Therefore, the fan 130 can be installed to be laid between the second condensing duct 1124 and the return duct 114. Therefore, the fan 130 having a sufficiently large size can be installed even though the installation space or the installation position is restricted. Therefore, the drying performance of the dishwasher 1 can be improved by the simple configuration and at low cost, and the dishwasher 1 can have a compact structure having a small size. In this case, the fan 130 can be a centrifugal fan. In addition, since the motor 136 can be disposed above the fan blade 132, it can be possible to help to prevent the water from being introduced into the motor 136.

The heater 140 can be disposed between the downstream end 1124D of the condensing duct 112 and the downstream end 114D of the return duct 114. For example, the heater 140 can be disposed in the return duct 114.

Therefore, the heater 140 can heat the air in the downstream portion (e.g., the return duct) of the drying duct 110 close to the outlet port H2 and discharge the high-temperature dry air into the washing space 12S, thereby improving the drying performance by the simple configuration and at low cost.

The heater 140 can be disposed in the return duct 114 (FIGS. 10 to 15). However, the present disclosure is not limited to this configuration. For example, unlike the drawings, the heater 140 can be provided adjacent to the return duct 114 and disposed outside the return duct 114.

Since the heater 140 is disposed in the return duct 114 as described above, the air can be effectively heated in the return duct 114 close to the outlet port H2. Therefore, the heated air flowing into the washing space 12S can effectively remove moisture remaining on dishes in the washing space 12S. Therefore, the drying performance can be improved by the simple structure and at low cost.

In addition, since the heater 140 is disposed in the return duct 114, the heater 140 is positioned to be distant from the water introduced into the condensing duct 112 or the water condensed in the condensing duct 112 without coming into contact with the water. Therefore, it can be possible to help to prevent the heat generated by the heater 140 from vaporizing a large amount of water collected in the condensing duct 112. Therefore, the high-temperature dry air in the return duct 114 can flow into the washing space 12S, thereby improving the drying performance.

The heater 140 can heat the air in the drying duct 110.

As described above, the drying device 100 includes the drying duct 110, the fan 130, and the heater 140, and the drying duct 110 is disposed outside the tub 12 and includes the condensing duct 112 and the return duct 114, which makes it possible to improve the drying performance by the simple configuration and at low cost.

As illustrated in FIG. 14, the distributor 150 can include an insertion part 152 and a lid 154.

A lower end of the insertion part 152 can communicate with the downstream end 114D of the return duct 114, and an upper end of the insertion part 152 can be coupled to the lid 154. The insertion part 152 can be installed to penetrate the outlet port H2 formed in the bottom 12B of the tub 12.

The air heated in the return duct 114 can flow into the washing space 12S through the insertion part 152.

The lid 154 can be installed at an upper end of the insertion part 152 and disposed in the washing space 12S.

The lid 154 can block the water in the washing space 12S from being introduced into the insertion part 152 and the return duct 114.

In addition, the lid 154 can prevent the air flowing out of the insertion part 152 from flowing upward in the vertical direction when the air is introduced into the washing space 12S. Therefore, since the condition i) is provided, the dry air introduced into the washing space 12S through the outlet port H2 can effectively circulate everywhere in the washing space 12S until the dry air is introduced into the drying device 100 through the inlet port H1, thereby improving the drying efficiency.

In some examples, the second downstream duct 1124B, the fan housing 134, and the return duct 114 illustrated in FIGS. 11 to 13 can include a first housing C1, a second housing C2, a third housing C3, and a fourth housing C4, as illustrated in FIG. 14.

The first housing C1 can be disposed at the lower side and opened upward.

The second housing C2 can be disposed on the first housing C1 and coupled to the first housing C1.

The third housing C3 can be opened downward, disposed on the second housing C2, and coupled to the second housing C2.

The fourth housing C4 can be disposed on one end of the second housing C2 and coupled to the second housing C2.

The second downstream duct 1124B can be defined by the first housing C1 and the second housing C2, and the return duct 114 can be defined by the second housing C2 and the third housing C3. The separation wall W can be the bottom of the second housing C2.

The fan housing 134 can be defined by one end of the second housing C2 and the fourth housing C4. That is, a part of the fan housing 134 (one end of the second housing) can be integrated with a part of the return duct 114 (the remaining part of the second housing). The fourth housing C4 can be the upper wall 134T of the fan housing 134.

The second water drain port D2 can be formed in the bottom of the first housing C1, and the third water drain port D3 can be formed in the bottom of the second housing C2.

The heater 140 can be disposed in the internal space defined by coupling the second housing C2 and the third housing C3. In this case, a fixing part 142, which has high heat resistance and low thermal conductivity, can be fixed to the second housing C2 or the third housing C3, and the heater 140 can be installed by being coupled to the fixing part 142. Therefore, it can be possible to help to prevent the second housing C2 or the third housing C3 from being damaged by the heater 140.

As described above, the second downstream duct 1124B, the fan housing 134, and the return duct 114 can be configured by coupling the first housing C1, the second housing C2, the third housing C3, and the fourth housing C4. Therefore, the drying device 100 can be simply and easily manufactured and easily maintained. Further, the drying device 100 can have a compact structure having a small size.

In some examples, for convenience, the configuration has been described in which the drying duct 110 is divided into the condensing duct 112 and the return duct 114. However, the condensing duct 112 and the return duct 114 can be integrated.

In some examples, the first condensing duct 1122 and the second condensing duct 1124 can also be integrated.

In some implementations, the ducts 110, 112, 1122, 1124, and 114 can each be made of a metallic material such as aluminum or stainless steel. In some examples, the ducts 110, 112, 1122, 1124, and 114 can be manufactured by steel metal working or injection molding.

In some examples, some components of the drying device 100, such as the fan 130, can be made of plastic.

While the present disclosure has been described above with reference to the accompanying drawings, the present disclosure is not limited to the drawings and the implementations disclosed in the present specification, and it is apparent that the present disclosure can be variously changed by those skilled in the art without departing from the technical spirit of the present disclosure. Further, even though the operational effects of the configurations of the present disclosure have not been explicitly disclosed and described in the description of the implementations of the present disclosure, the effects, which can be expected by the corresponding configurations, should be acceptable.

What is claimed is:

1. A dishwasher comprising:

a tub having a washing space that is defined by:

a rear wall facing a front side of the tub in a first direction, a first sidewall having an inlet port defined at a rear upper portion thereof, a second sidewall facing the first sidewall in a second direction, a bottom portion of the tub, the bottom portion defining an outlet port at a rear corner area of the bottom portion connected to the rear wall and the first sidewall, an upper wall facing the bottom portion in a vertical direction;

a door disposed at the front side of the tub and configured to open and close at least a portion of the washing space; and a drying device configured to supply air to the washing space, the drying device comprising:

a drying duct that is disposed outside the tub and in fluid communication with the inlet port and the outlet port, the drying duct comprising a condensing duct and a return duct, a fan configured to cause a flow of air in the drying duct, and a heater configured to heat the air in the drying duct, wherein the condensing duct comprises:

a first condensing duct that faces an outer surface of the first sidewall of the tub and has a first upstream end in fluid communication with the inlet port, and a second condensing duct that is disposed vertically below the bottom portion of the tub and has a second upstream end in fluid communication with a first downstream end of the first condensing duct, wherein the return duct comprises:

a return upstream end that is in fluid communication with a second downstream end of the second condensing duct, and a return downstream end that is in fluid communication with the outlet port, wherein the second condensing duct has an upper surface that extends to the second downstream end in a direction along the return duct, and wherein the return duct is disposed between the bottom portion of the tub and the upper surface of the second condensing duct and defines a flow path from the return upstream end toward the return downstream end in a direction opposite to the direction of the second condensing duct.

2. The dishwasher of claim 1, wherein the outlet port and the inlet port are defined at positions on an imaginary vertical plane that extends in the second direction and the vertical direction.

3. The dishwasher of claim 1, wherein the second condensing duct is curved at the second downstream end and extends in the vertical direction.

4. The dishwasher of claim 1, wherein a horizontal distance between the second upstream end and the second downstream end is greater than a horizontal distance between the second upstream end and the outlet port.

5. The dishwasher of claim 1, wherein the second condensing duct and the return duct are positioned vertically below a rear portion of the bottom portion of the tub.

6. The dishwasher of claim 1, wherein at least a portion of the return duct faces and extends along the second condensing duct in a horizontal direction, and wherein the drying device further comprises a separation wall that is disposed between the return duct and the second condensing duct and extends in the horizontal direction, the separation wall defining the upper surface of the second condensing duct.

7. The dishwasher of claim 6, wherein the separation wall defines a water drain hole in fluid communication with the return duct and the second condensing duct.

8. The dishwasher of claim 1, wherein the fan and the heater are disposed between the second downstream end of the second condensing duct and the return downstream end of the return duct.

9. The dishwasher of claim 1, wherein the heater is disposed in the return duct.

10. The dishwasher of claim 1, wherein the fan is disposed vertically above the second downstream end of the second condensing duct and in fluid communication with the return duct.

11. The dishwasher of claim 10, wherein the fan comprises:

a fan blade;

a motor disposed vertically above the fan blade and configured to rotate the fan blade; and a fan housing that accommodates the fan blade, the fan housing comprising a housing upper wall, and wherein the housing upper wall is disposed between the fan blade and the motor and faces the second downstream end of the second condensing duct and the return upstream end of the return duct.

12. The dishwasher of claim 1, wherein the fan comprises a rotary shaft that extends in the vertical direction.

13. The dishwasher of claim 1, wherein the first downstream end of the first condensing duct and the second upstream end of the second condensing duct are positioned adjacent to a rear lower portion of the first sidewall.

14. The dishwasher of claim 1, further comprising:

a cold air supply module that is disposed outside the tub and at least partially overlaps with the first condensing duct.

15. The dishwasher of claim 14, wherein the cold air supply module comprises:

a first outside air inflow duct disposed lower than the bottom portion of the tub and configured to receive air from an outside of the drying device;

a second outside air inflow duct that faces the outer surface of the first sidewall and is in fluid communication with a downstream end of the first outside air inflow duct; and a heat exchange flow path part that is connected to the first condensing duct and in fluid communication with a downstream end of the second outside air inflow duct.

16. The dishwasher of claim 15, further comprising a cooling fan that is disposed in the first outside air inflow duct or an upstream end of the first outside air inflow duct, the cooling fan being configured to draw air from the outside toward the first outside air inflow duct.

17. The dishwasher of claim 15, wherein the heat exchange flow path part extends in the first direction toward the first upstream end of the first condensing duct along an outer circumferential surface of the first condensing duct and has a downstream end that is open to an outside of the heat exchange flow path part.

18. The dishwasher of claim 1, wherein the inlet port is configured to receive air and moisture from the washing space and to supply the air and the moisture to the first condensing duct, the first condensing duct being configured to guide the air and the moisture from the first upstream end to the first downstream end, and wherein the second condensing duct is configured to receive the air and the moisture from the first condensing duct through the second upstream end and to guide the air and the moisture to the second downstream end.

19. The dishwasher of claim 18, wherein the heater is disposed in the return duct, and the return duct is configured to guide air heated by the heater toward the return downstream end, and wherein the outlet port is configured to receive the heated air from the return duct and to supply the heated air to the washing space.

20. The dishwasher of claim 1, wherein the upper surface of the second condensing duct is parallel to a horizontal direction, and wherein the second condensing duct has a lower surface that is spaced apart from the upper surface in the vertical direction and inclined with respect to the horizontal direction.

* * * * *